US008708064B2

(12) United States Patent
Downton et al.

(10) Patent No.: US 8,708,064 B2
(45) Date of Patent: Apr. 29, 2014

(54) SYSTEM AND METHOD TO CONTROL STEERING AND ADDITIONAL FUNCTIONALITY IN A ROTARY STEERABLE SYSTEM

(75) Inventors: Geoffrey C. Downton, Minchinhampton (GB); Brian Clark, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 346 days.

(21) Appl. No.: 12/977,250

(22) Filed: Dec. 23, 2010

(65) Prior Publication Data

US 2012/0160565 A1 Jun. 28, 2012

(51) Int. Cl.
*E21B 7/06* (2006.01)

(52) U.S. Cl.
USPC ..... 175/61; 175/73; 175/45

(58) Field of Classification Search
None
See application file for complete search history.

(56) References Cited

U.S. PATENT DOCUMENTS

| | | | | |
|---|---|---|---|---|
| 5,520,255 | A * | 5/1996 | Barr et al. | 175/24 |
| 5,553,678 | A * | 9/1996 | Barr et al. | 175/73 |
| 5,685,379 | A * | 11/1997 | Barr et al. | 175/61 |
| 5,803,185 | A * | 9/1998 | Barr et al. | 175/45 |
| 2002/0179336 | A1 * | 12/2002 | Schaaf et al. | 175/61 |
| 2006/0249287 | A1 * | 11/2006 | Downton et al. | 166/250.1 |
| 2007/0221409 | A1 | 9/2007 | Hall et al. | |
| 2009/0086576 | A1 | 4/2009 | Downton et al. | |

OTHER PUBLICATIONS

Search report from the equivalent GB patent application No. 1121969.8 issued on Mar. 12, 2012.

* cited by examiner

*Primary Examiner* — Jennifer H Gay
*Assistant Examiner* — Caroline Butcher
(74) *Attorney, Agent, or Firm* — Chadwick A. Sullivan; Brigitte Echols

(57) ABSTRACT

A system and methodology provide control over the directional drilling of a wellbore while enabling additional functionality. A rotational valve is mounted within a drill collar of a rotary steerable system to control flow of actuating fluid to one or more steering pads which are selectively moved in a lateral direction with respect to the rotary steerable system. The rotational valve also is controlled to carry out at least one additional function while controlling the direction of drilling.

20 Claims, 18 Drawing Sheets

SYSTEM AND METHOD TO CONTROL STEERING AND ADDITIONAL FUNCTIONALITY IN A ROTARY STEERABLE SYSTEM

BACKGROUND

A variety of valves are used to control flow of actuating fluids in many well applications and other flow control applications. For example, valves are employed in wellbore drilling applications to control the actuation of tools located in the wellbore being drilled. During wellbore drilling operations, valves positioned in a drilling assembly can be selectively actuated to control the direction of drilling. The valves may be positioned, for example, to control the flow of drilling mud to actuating pads which are extended and contracted in a controlled manner to steer the drill bit and thereby drill the wellbore in a desired direction.

In some drilling applications, rotary steerable systems are employed to control the direction of drilling during formation of the wellbore. A rotary steerable system may utilize a drill bit coupled with a drill collar and rotated to drill through the rock formation. A plurality of steering pads is selectively actuated in a lateral direction to control the direction of drilling, and the steering pads may be controlled by a variety of valves and control systems. In some applications, rotary valves are held at desired angular orientations with respect to the rotating drill collar to control flow of drilling mud to the steering pads. A rotary valve may be held in a geostationary position by a control cartridge in, for example, a strap-down system. However, existing systems are limited with respect to accurately controlling the direction of drilling, providing options for changing the direction of drilling, and performing additional functions while drilling. Existing strap-down systems use a motor to orientate a valve opening but provide no advanced control. The motor either keeps the valve geostationary or allows it to rotate slowly.

SUMMARY

In general, a system and methodology is provided to facilitate control over the directional drilling of a wellbore while enabling additional functionality, e.g. providing telemetry capability. A rotational valve is mounted within a drill collar of a rotary steerable system to control flow of actuating fluid to one or more steering pads which are selectively moved in a lateral direction with respect to the rotary steerable system. The rotational valve also is controlled to carry out at least one additional function, e.g. providing telemetry signals, while enabling enhanced control over the flow of actuating fluid to the steering pads.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The embodiments described herein generally relate to a system and method for drilling wellbores. The system and methodology employ a rotary steerable system which may be operated to control the direction of drilling during formation of the wellbore. The rotary steerable system comprises one or more steering pads mounted on a drill collar, and the steering pad or pads are selectively actuated to control the orientation of the drill collar in the direction of drilling. The steering pads are actuated by an actuating fluid, and flow of the actuating fluid to the steering pads is controlled by a rotational valve, e.g. a spider valve, which may be operated by a controlled motor.

According to one embodiment, a motor controlled rotational valve is used in combination with orientation sensors and a controller, e.g. microprocessor, to enable improved control of the rotary steerable system. For example, operation of the rotational valve may be controlled to provide directional drilling of a wellbore in numerous selected directions and severities of deviation. The rotational valve also may be selectively controlled to perform an additional and entirely different function. For example, the rotational valve may be controlled and operated as a telemetry device able to provide pressure signal communications with another device or devices downhole and/or with a surface system.

Figure 1:
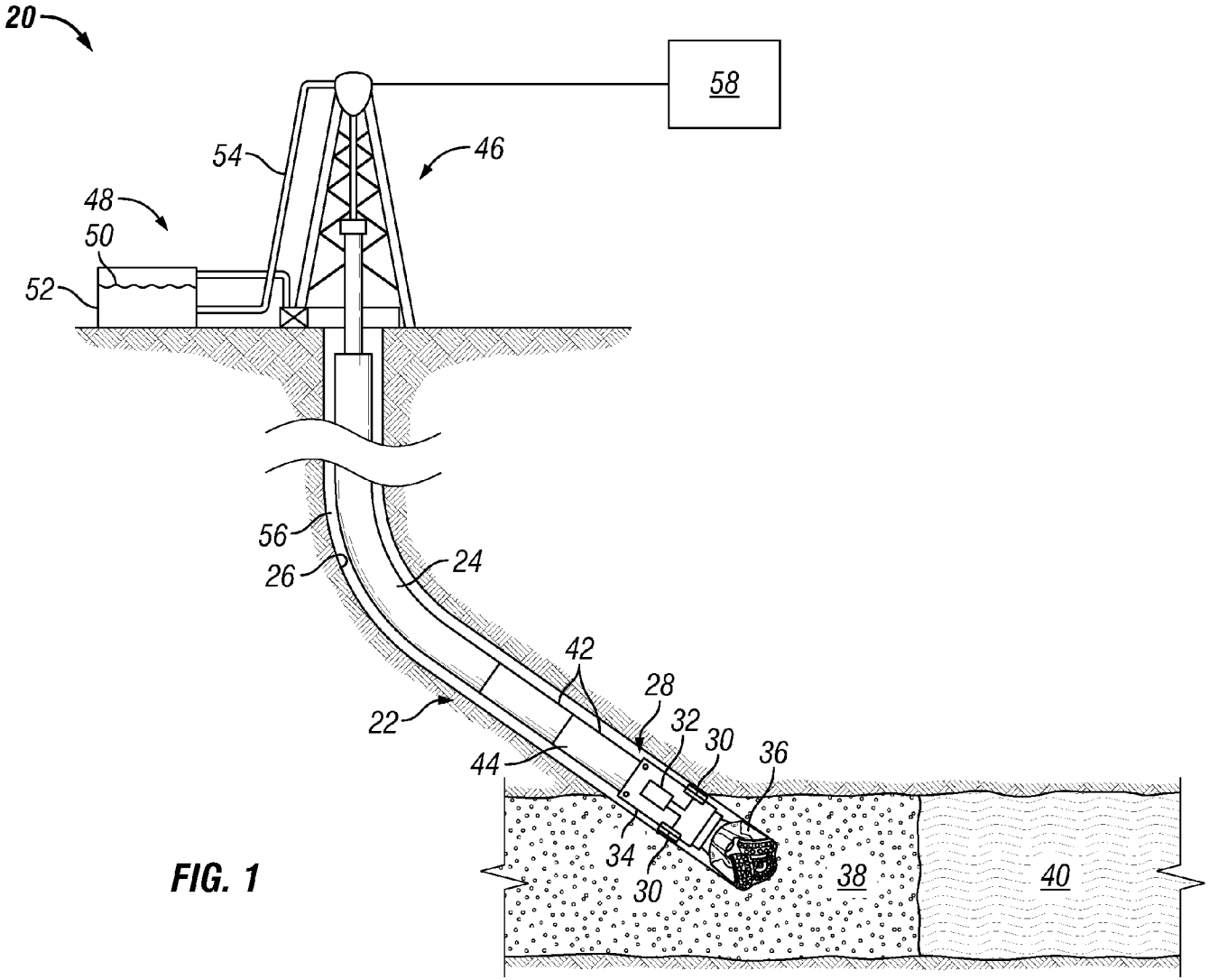
FIG. 1 is a schematic illustration of an example of a drill string which includes a rotary steerable system employing a rotational valve, according to an embodiment of the present invention.

Referring generally to FIG. 1, an embodiment of a drilling system 20 is illustrated as having a bottom hole assembly 22 which is part of a drill string 24 used to form a desired, directionally drilled wellbore 26. The illustrated drilling system 20 comprises a rotary steerable system 28 having at least one laterally movable steering pad 30 controlled by a valve system 32. By way of example, the steering pads 30 may be designed to act against a corresponding pivotable component of the rotary steerable system 28 or against the surrounding wellbore wall to provide directional control. In this particular embodiment, the valve system 32 is positioned within a drill collar 34 of the rotary steerable system 28. The drill collar 34 is coupled with a drill bit 36 which is rotated to cut through a surrounding rock formation 38 which may be in a hydrocarbon bearing reservoir 40.

Depending on the environment and the operational parameters of the drilling operation, drilling system 20 may comprise a variety of other features. For example, drill string 24 may include additional drill collars 42 which, in turn, may be designed to incorporate desired drilling modules, e.g. logging-while-drilling and/or measurement-while-drilling modules 44. In some applications, stabilizers may be used along the drill string to stabilize the drill string with respect to the surrounding wellbore wall.

Various surface systems also may form a part of the drilling system 20. In the example illustrated, a drilling rig 46 is positioned above the wellbore 26 and a drilling fluid system 48, e.g. drilling mud system, is used in cooperation with the drilling rig 46. For example, the drilling fluid system 48 may be positioned to deliver a drilling fluid 50 from a drilling fluid tank 52. The drilling fluid 50 is pumped through appropriate tubing 54 and delivered down through drilling rig 46 and into drill string 24. In many applications, the return flow of drilling fluid flows back up to the surface through an annulus 56 between the drill string 24 and the surrounding wellbore wall. The return flow may be used to remove drill cuttings resulting from operation of drill bit 38. The drilling fluid 50 also may be used as an actuating fluid to control operation of the rotary steerable system 28 and its movable steering pad or pads 30. In this latter embodiment, flow of the drilling/activating fluid 50 to steering pads 30 is controlled by valve system 32 in a manner which enables control over the direction of drilling during formation of wellbore 26.

The drilling system 20 also may comprise many other components, such as a surface control system 58. The surface control system 58 can be used to communicate with rotary steerable system 28. In some embodiments, the surface control system 58 receives data from downhole sensor systems and also communicates commands to the rotary steerable system 28 to control actuation of valve system 32 and thus the direction of drilling during formation of wellbore 26. In other applications, as discussed in greater detail below, control electronics are located downhole in the rotary steerable system 28 and the control electronics cooperate with an orientation sensor to control the direction of drilling. However, the downhole, control electronics may be designed to communicate with surface control system 58, to receive directional commands, and/or to relay drilling related information to the surface control system.

Figure 2:
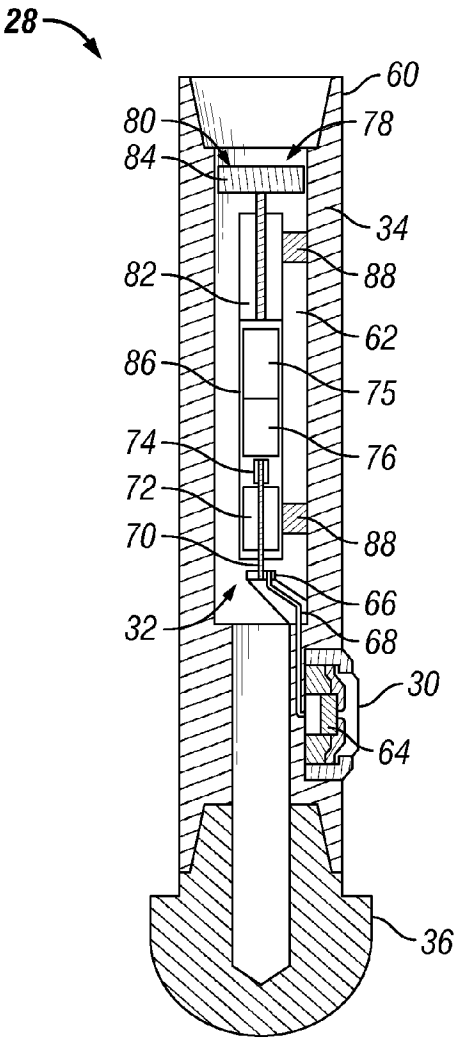
FIG. 2 is a schematic illustration of an example of a rotary steerable system, according to an embodiment of the present invention.

Referring generally to FIG. 2, an illustration is provided of one embodiment of the rotary steerable system 28. In this embodiment, drill bit 36 is mounted to the drill collar 34 which has a connector end 60 opposite drill bit 36. Connector end 60 is designed for coupling the rotary steerable system 28 to the next adjacent, uphole component of drill string 24. Additionally, the drill collar 34 comprises a hollow interior 62 designed to hold a variety of rotary steerable system components. An individual steering pad 30 or a plurality of movable steering pads 30 also may be mounted to the drill collar 34 for lateral, e.g. radial movement, with respect to the drill collar. In one example, each steering pad of a plurality of steering pads 30 may be moved by a corresponding piston 64 which is hydraulically actuated via drilling/activating fluid 50 appropriately metered by valve system 32.

In the example illustrated, valve system 32 comprises a rotational valve 66, such as a spider valve. The spider valve 66 may be selectively rotated to enable flow of activating fluid 50 and/or to block flow of activating fluid 50 with respect to selected individual and/or multiple steering pads 30. By way of example, the actuating fluid 50 may be delivered through hydraulic lines 68 to act against pistons 64. During rotation of drill collar 34 and drill bit 36 for drilling of wellbore 26, the spider valve 66 undergoes a controlled, relative rotation to ensure either delivery of the activating fluid 50 through desired hydraulic line 68 to desired movable steering pads 30 or blockage of the activating fluid 50. Additionally, the spider valve 66 may be selectively rotated to control other types of functions, e.g. telemetry functions, downhole. For example, the spider valve 66 may be controlled to cause pressure changes, e.g. pressure pulses, in the activating fluid 50, and these pressure changes/pulses may be used as telemetry signals which are detected by another device or devices.

As illustrated, spider valve 66 is mounted to a drive shaft 70 which is rotated by a motor 72, such as an electric motor. One or more sensors 74, such as an encoder, also may be operatively engaged with drive shaft 70 to monitor the angular orientation of spider valve 66 relative to the drill collar 34. The rotary steerable system 28 further comprises control electronics 75 which may comprise a micro-controller 76, e.g. a microprocessor. The micro-controller 76 receives data from the sensors/encoder 74 and uses the data to control motor 72 which, in turn, controls the angular positioning of spider valve 66. The controller 76 also may be designed for communication with surface control system 58 to receive commands and/or to relay data. Furthermore, control electronics 75 may comprise additional components, such as a direction and inclination package containing magnetometers and accelerometers. Control over the spider valve position enables a unique control over duration of the side forces applied by one or more steering pads 30. The spider valve 66 moves synchronously with the drill collar 34, and the spider valve may be aligned with corresponding ports or blank spaces to control side force duration as discussed in greater detail below.

Electric power may be provided to controller 76, to motor 72, and to other components of rotary steerable system 28 via a suitable power source 78. By way of example, the power source 78 may comprise batteries and/or a turbine 80. The turbine 80 may comprise an alternator 82 driven by rotation of turbine blades 84 which are rotated by the pressurized flow of drilling/activating fluid 50 down through rotary steerable system 28 and drill bit 36. Several of the features of the rotary steerable system 28 may be mounted within a pressure housing 86 to protect them against the relatively high pressures of the drilling/activating fluid 50. For example, motor 72, encoder 74, controller 76, and alternator 82 may be disposed within a pressure housing 86. In this embodiment, the pressure housing 86 is rigidly attached to the drill collar 34 with suitable mounting structures 88, e.g. centralizers, disposed in the hollow interior 62 of drill collar 34. Thus, the pressure housing 86 rotates with the drill collar 34.

The rotary steerable system 28 comprises at least one movable steering pad 30, e.g. 1, 2, 3 or 4 movable steering pads, which are activated by the differential pressure between the inside and outside of the drill collar 34. When a particular steering pad 30 is activated and pushes against, for example, the surrounding formation, the rotary steerable system 28 is deflected in the opposite direction and provides the steering capability. As the drill collar 34 rotates, the spider valve 66 is able to selectively open or shut off pads 30 by allowing actuating fluid 50 to enter the selected hydraulic line 68 which delivers the actuating fluid 50 to the piston 64 behind the corresponding steering pad 30. The spider valve 66 is rotated by shaft 70 which is driven by motor 72 while the shaft encoder (or other sensor) 74 measures the rotational angle of the spider valve 66 relative to the drill collar 34. The shaft encoder 74 is a unique feature and may be mounted on the shaft 70 to allow the controller 76 or other processor to track the orientation of the spider valve 66 with respect to the drill collar 34. The spider valve 66 also may be rotated by shaft 70 to create pressure changes, e.g. pressure pulses, in associated vent ports, as described in greater detail below. In some applications, the spider valve 66 also may be used to control other functions unrelated to directional steering.

By controlling the position of rotational valve 66, e.g. spider valve, with electric motor 72, substantially greater steering capabilities and other functions are enabled. For example, in some applications, the spider valve 66 is operated to perform both steering functions and telemetry functions (or other functions) unrelated to actuation of the steering pads 30. Additionally, the motor controlled spider valve 66 may be operated and controlled to drill wellbore doglegs of varying build-rates according to several methods, such as varying the duration of the side force during each rotation of the drill collar 34.

In FIG. 1, the steering pads 30 are illustrated as acting against a surrounding wellbore wall. However, the rotary steerable system 28 may have a variety of other designs including hybrid designs which include features of both point-the-bit and push-the-bit systems. In such hybrid systems, the hydraulic lines 68 may deliver actuating fluid to corresponding pistons/pads to deflect a stabilizer sleeve. The deflection or pivotable movement of the stabilizer sleeve controls, e.g. changes, the direction of drilling.

Figure 3:
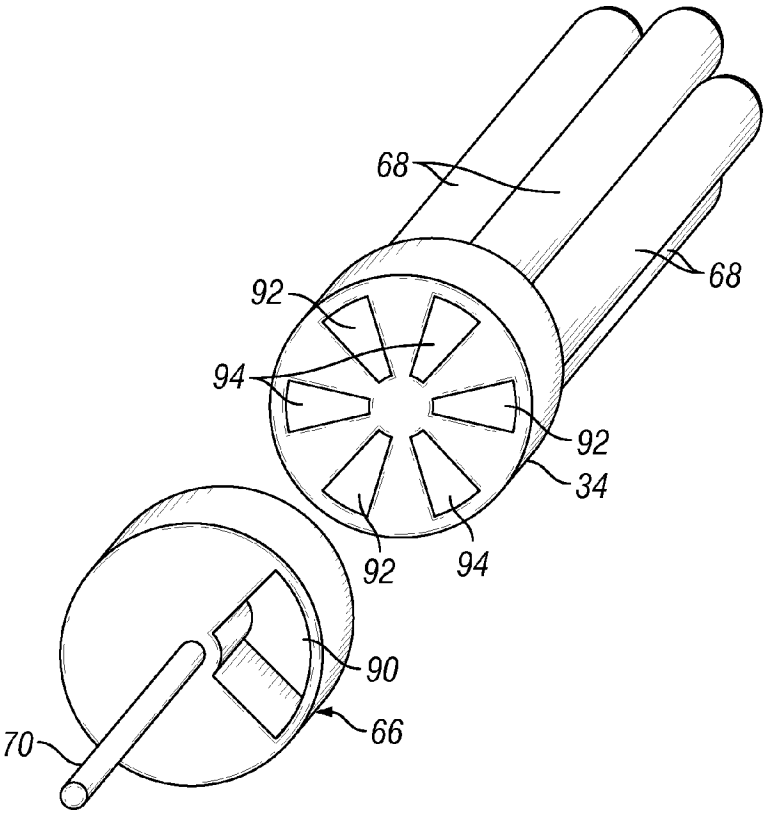
FIG. 3 is an exploded view of a rotational valve or spider valve which controls flow of actuating fluid to a plurality of ports associated with a drill collar of the rotary steerable system, according to an embodiment of the present invention.

Referring generally to FIG. 3, an exploded view of an embodiment of the spider valve 66 and corresponding drill collar ports is illustrated. In this embodiment, the spider valve 66 comprises a valve opening 90 which may be rotated to desired angular positions via motor 72. The valve opening 90 may be selectively aligned with selected ports of a plurality of ports including individual activating ports 92 and/or individual vent ports 94 which are part of and rotate with drill collar 34. The activating ports 92 deliver actuating fluid 50 into hydraulic lines 68 and on to the corresponding steering pads 30. The vent ports 94 also may be coupled with hydraulic lines 68 to vent pressure to the surrounding annulus or other region. In the specific example illustrated, the drill collar 34 comprises: three activating ports 92 connected to three steering pads 30 via hydraulic lines 68; and three vent ports 94. The valve opening 90 may be selectively aligned with individual activating ports 92 or vent ports 94 or combinations of adjacent activating and vent ports 94. It should be noted that additional steering pads 30, activating ports 92, and vent ports 94 may be used in some rotary steerable system designs. A plurality of activating ports 92 is illustrated to facilitate explanation. However, a single activating port 92 and vent port 94 may be employed to control a single steering pad 30. If a single pad 30 and port 92 are employed, the principle remains the same as described with respect to the plurality of steering pads and ports. Additionally, if certain pads fail to function properly, steering may still be achieved with a pair of pads or with a single pad.

The spider valve 66 is selectively rotated via shaft 70 and motor 72 to bring valve opening 90 into alignment or out of alignment with selected activating ports 92 and/or vent ports 94. To facilitate an understanding of the angular relationship of valve opening 90 with respect to activating ports 92 and vent ports 94, activating ports 92 have been labeled as first (1), second (2) and third (3) ports and vent ports 94 have been labeled as vent (V) ports. The first (1), second (2) and third (3) activating ports 92 correspond with first, second and third movable steering pads 30. The vent ports 94 are connected together and either vent fluid 50 to the surrounding annulus or to a common chamber. The valve opening 90 may be selectively aligned with desired ports 92, 94 to control the directional drilling of wellbore 26 and to perform additional functions, e.g. telemetry functions, as explained in greater detail below.

Figure 4A:
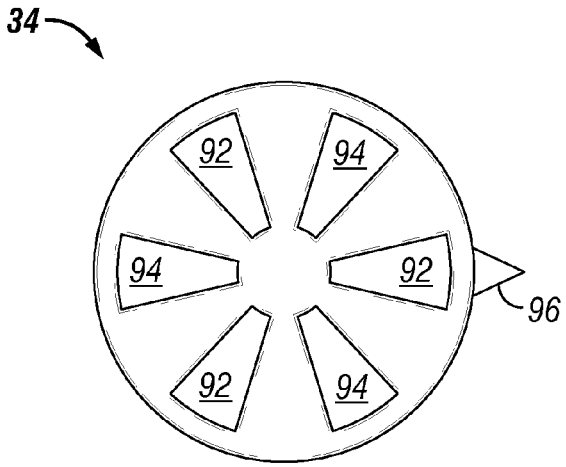
FIG. 4 is a schematic illustration showing the angular position of a valve opening through the rotational valve and the angular position of flow ports, according to an embodiment of the present invention.
Figure 4B:
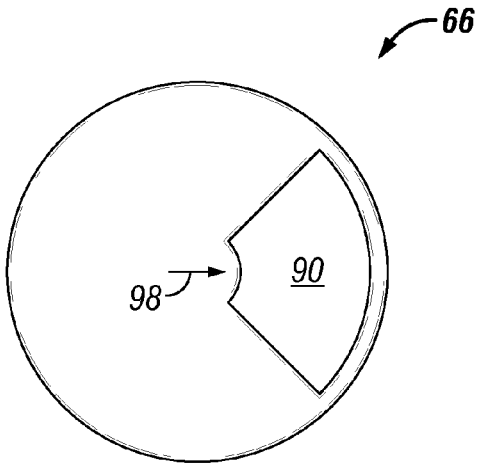
Figure 4C:
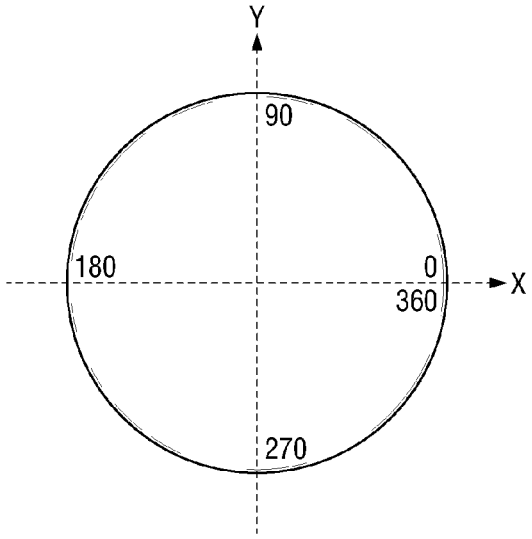

In FIG. 4, a schematic illustration shows the spider valve 66 with its valve opening 90 located at 0°. The first (1), second (2), and third (3) activating ports 92 of the drill collar are illustrated as positioned at 0°, 240° and 120°, respectively, and those activating ports correspond with movable steering pads located at angular positions of 0°, 240°, and 120° around the drill collar 34. The vent ports 94 are centered at angles of 60°, 180° and 300°. The size of the valve opening 90 and ports 92, 94 may vary according to a variety of design parameters. In one example, however, the valve opening 90 has an angular width of 90° and each of the ports 92, 94 has an angular width of 24°. However, the angular widths and radial lengths of the valve opening 90 and ports 92, 94 may be changed for different applications. FIG. 4 and subsequent figures employ a triangular marker 96 which indicates the rotational angle of the drill collar 34 and its first (1) activating port 92. Similarly, an arrow marker 98 is employed to indicate the rotational angle of the spider valve 66 and centered valve opening 90.

In the embodiment illustrated, the angular positions and the angular widths of the ports 92, 94 and the valve opening 90 have been selected so that either one or two ports 92, 94 may be activated. For example, if the spider valve 66 and the drill collar 34 are both positioned at 0°, then the first (1) activating port 92 is activated by the pressure of fluid 50, e.g. mud pressure, but no other port is activated. If the drill collar angle is 0° while the spider valve angle is 30°, then the first (1) activating port 92 and an adjacent vent port 94 are both activated. Consequently, the vent port 94 can be toggled on/off while maintaining the spider valve 66 in a position to activate the first (1) activating port 92 and its corresponding steering pad 30. This enables the spider valve 66 to perform a second function, such as a mud pulse telemetry function.

When one steering pad 30 is always activated during full steering mode, the spider valve 66 can be controlled to modulate pressure on the vent ports 94 to provide a telemetry signal. The spider valve 66 also may be operated to provide a straight drilling mode by positioning the valve opening 90 over only one of the vent ports 94 and not over any of the activating ports 92 so that no steering pads 30 are activated. As the drill collar 34 rotates, the spider valve 66 is controlled to maintain this alignment with respect to the vent port during drilling of a straight section of wellbore.

Figure 5:
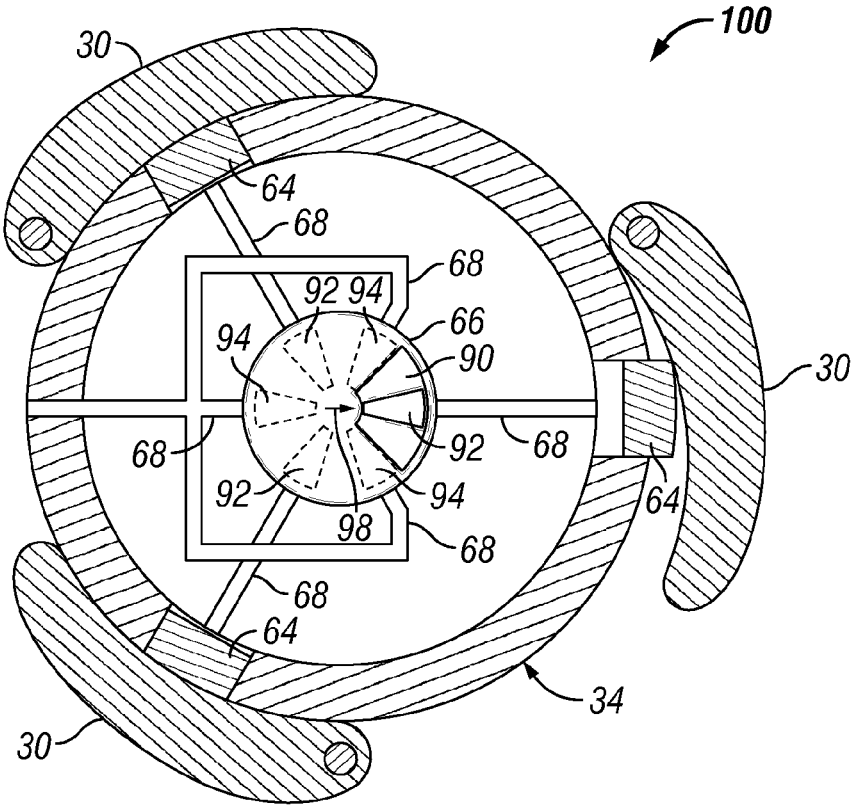
FIG. 5 is a schematic illustration showing the angular position of the valve opening to enable flow of actuating fluid to a first steering pad, according to an embodiment of the present invention.

Referring generally to FIG. 5, a schematic illustration is provided in which the spider valve 66 has been operated to apply a side force to the rotary steerable assembly 28. To apply the side force, the spider valve 66 is controllably operated to open activating ports 92 in a manner which activates the corresponding steering pads 30 during specific angles of rotation of the drill collar 34.

In FIG. 5, for example, the drill collar 34 and the spider valve 66 are both positioned at a 0° angle so that the valve opening 90 is aligned only with first (1) activating port 92. This allows flow of activating fluid 50, e.g. drilling mud, to the corresponding first steering pad 30, but no activating fluid 50 is vented to the annulus 100 through any of the vent ports 94. The closest vent ports 94 positioned at 60° and 240° are closed because their openings are separated by an angle of 96°, while the valve opening 90 has an angular width of 90°. Consequently, the valve opening 90 of spider valve 66 does not overlap either adjacent vent opening 94 when positioned in this configuration.

The pressure (P1) inside the drill collar 34 is greater than the pressure (P2) in the surrounding annulus to force the first steering pad 30 to a radially extended position, as illustrated in FIG. 5. The force (F) acting on the first steering pad 30 is equal to the area (A) of the hydraulic piston 64 times the differential pressure ($\Delta P = P1 - P2$) between the chamber containing piston 64 and the annular pressure. If the valve opening 90 and the port openings 92, 94 are sufficiently large, the differential pressure is equal to the pressure drop between the inside and outside of the drill collar 34. As illustrated in FIG. 5, the force of the first steering pad 30 acting against the surrounding wellbore wall deflects the drill bit 36 in the negative x-direction. In this configuration, no activating fluid 50 is vented to the annulus 100 outside the drill collar 34. It should be noted that only the relative angle between the drill collar 34 and the spider valve 66 is important in determining which ports 92, 94 are open.

Figure 6:
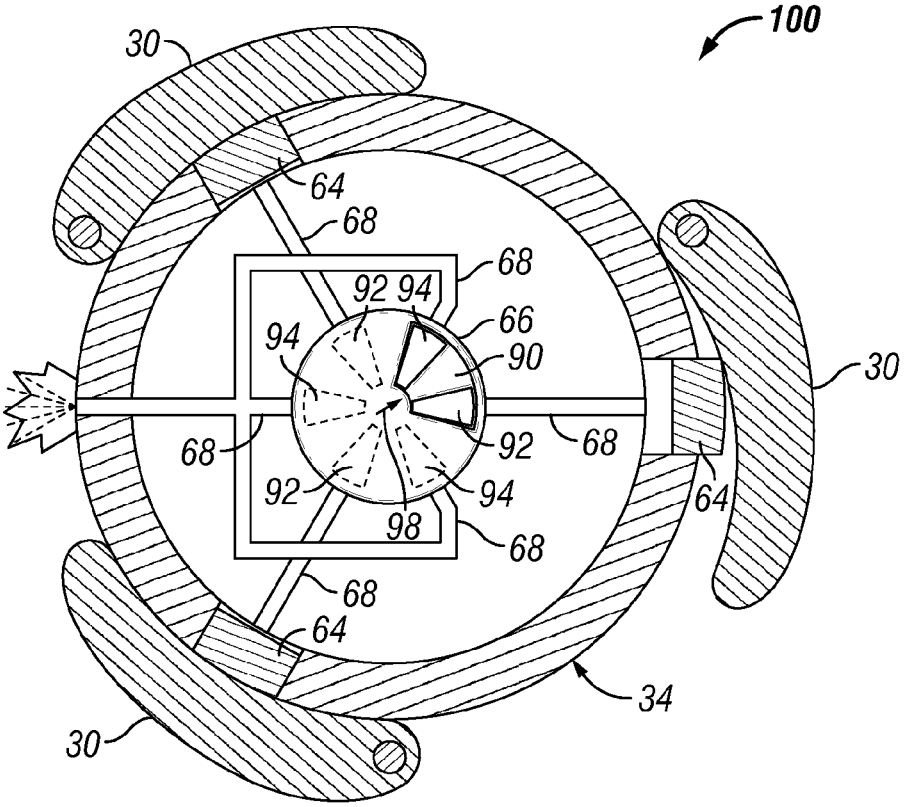
FIG. 6 is a schematic illustration showing the angular position of the valve opening to enable flow of actuating fluid through an activating port to a steering pad and through a vent port, according to an embodiment of the present invention.

In the configuration illustrated in FIG. 6, the drill collar angle is 0° while the spider valve angle is 30° which causes the valve opening 90 to be in alignment with both the first (1) activating port 92 and an adjacent vent port 94. Consequently, the corresponding first steering pad is activated and activating fluid 50 is vented to the annulus 100. Both the first (1) activating port 92 at 0° and the corresponding vent port 94 at 30° are open to the inner pressure P1 because the spider valve opening 90 has an angular width of 90° which spans both ports 92, 94. The flow of activating fluid 50 through the first (1) activating port 92 to the corresponding steering pad 30 affects the drill collar 34 in the negative x-direction while the activating fluid flow through the open vent port 94 can produce a drop in the inner pressure P1. Consequently, a negative pressure pulse is created, and the negative pressure pulse propagates inside the drill string. This pressure pulse and/or additional pressure pulses can form the basis for a pressure pulse communication system, such as a mud pulse communication system. The pressure changes, e.g. pulses, can be used to transmit data from the rotary steerable system 28 to another downhole tool or tools. In some embodiments, the pressure pulses may be transmitted uphole to provide data to a surface system and/or to another system located uphole from the rotary steerable system 28.

Figure 7:
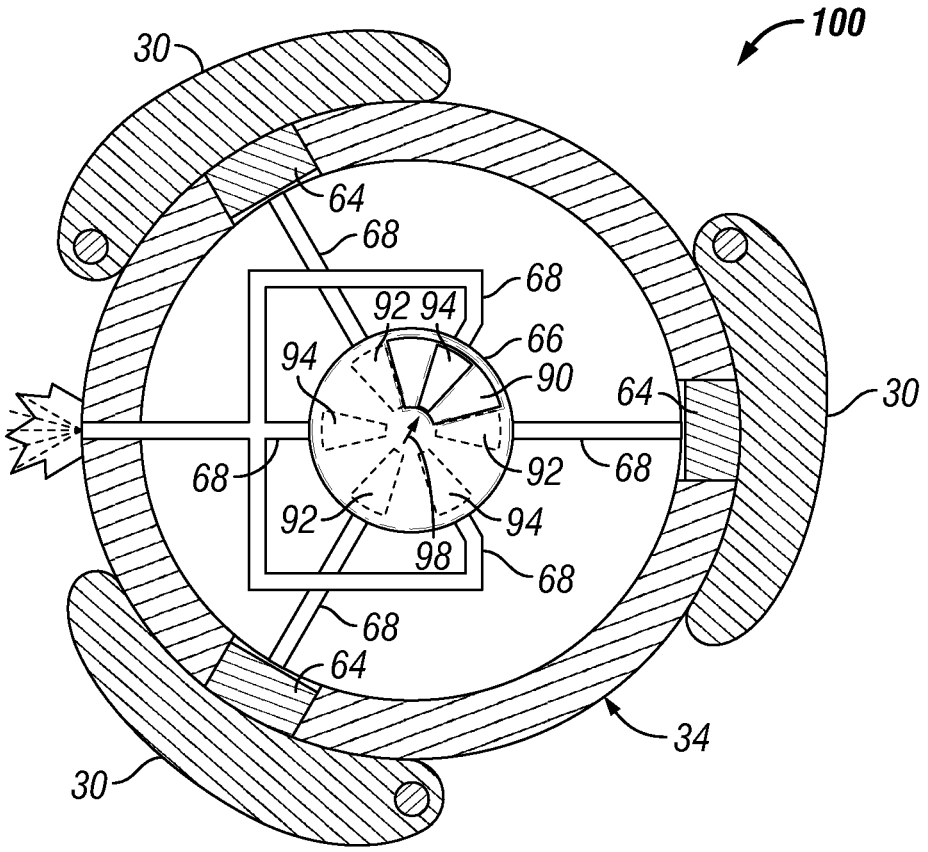
FIG. 7 is a schematic illustration showing the angular position of the valve opening to enable flow of actuating fluid to a vent port, according to an embodiment of the present invention.
Figure 8A:
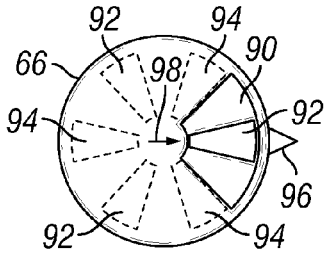
FIG. 8 is a schematic illustration showing the angular position of the valve opening to enable flow of actuating fluid to cause directional steering, according to an embodiment of the present invention.
Figure 8B:
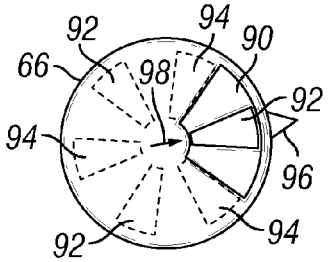
Figure 8C:
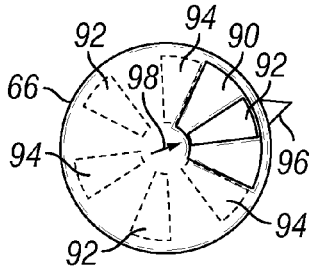
Figure 8D:
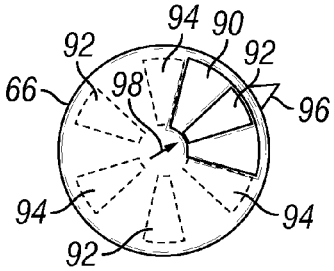
Figure 8E:
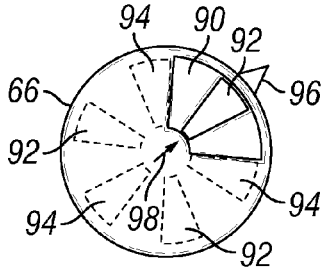
Figure 8F:
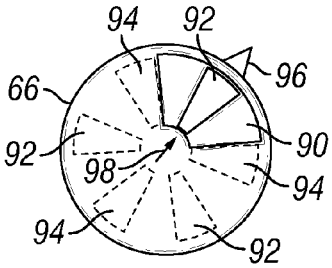
Figure 8G:
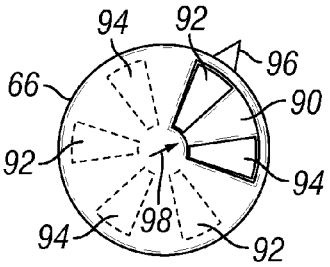
Figure 8H:
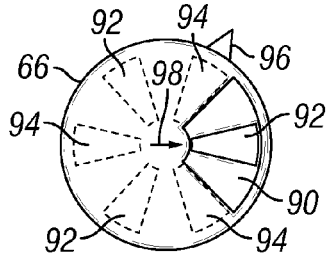
Figure 8I:
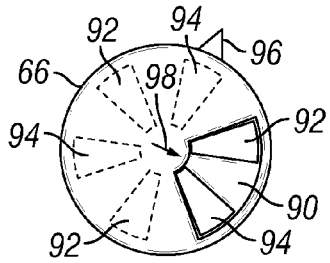
Figure 8J:
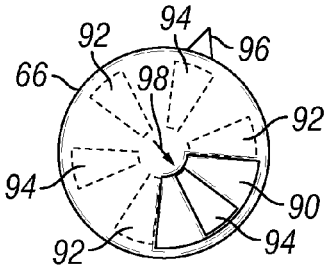
Figure 8K:
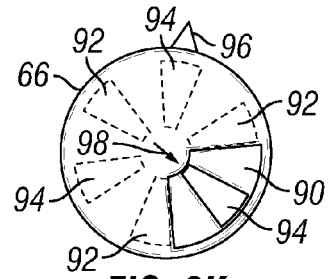
Figure 8L:
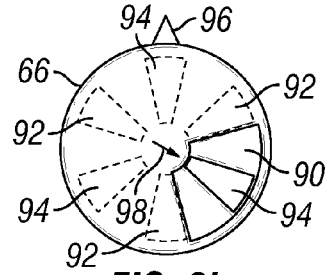
Figure 8M:
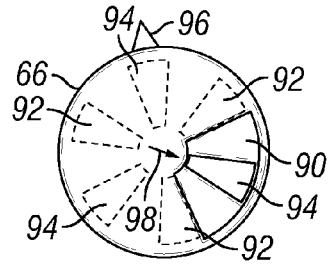
Figure 8N:
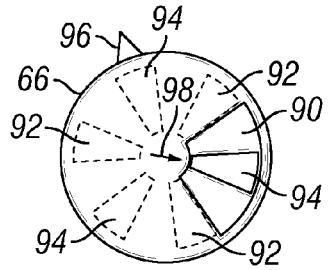
Figure 8O:
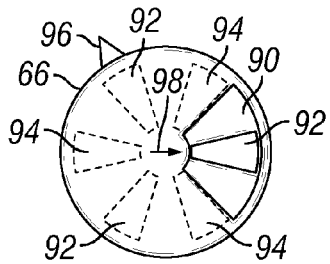
Figure 9A:
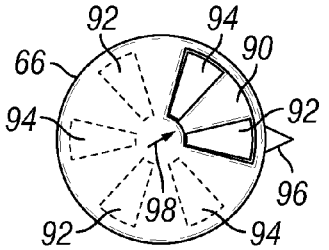
FIG. 9 is a schematic illustration showing the angular position of the valve opening to enable flow of actuating fluid to cause directional steering while venting pressure to the annulus, according to an embodiment of the present invention.
Figure 9B:
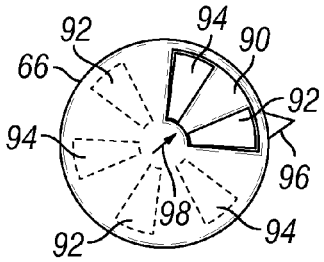
Figure 9C:
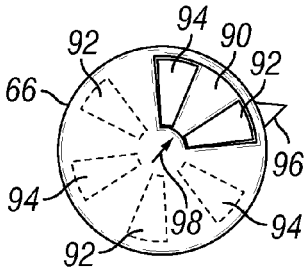
Figure 9D:
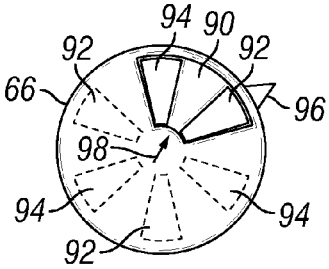
Figure 9E:
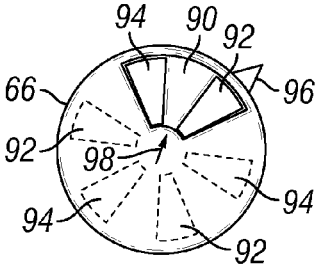
Figure 9F:
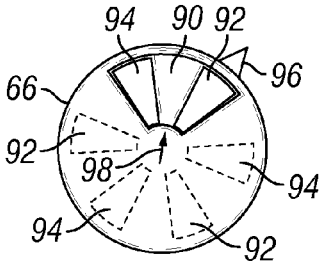
Figure 9G:
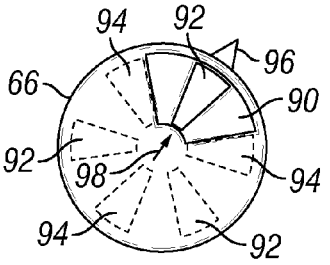
Figure 9H:
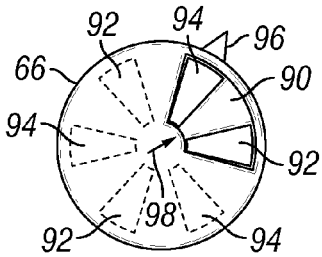
Figure 9I:
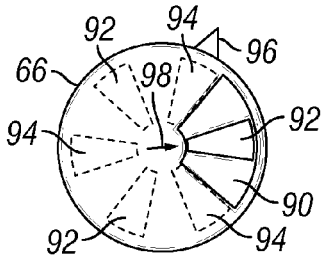
Figure 9J:
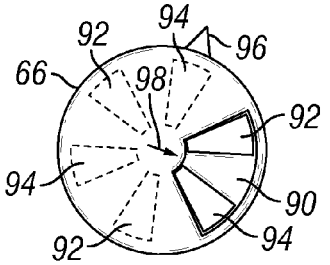
Figure 9K:
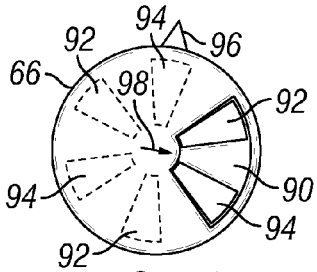
Figure 9L:
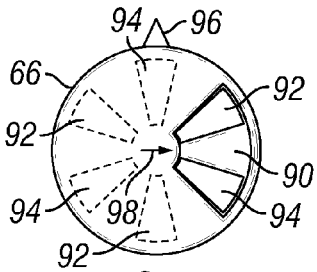
Figure 9M:
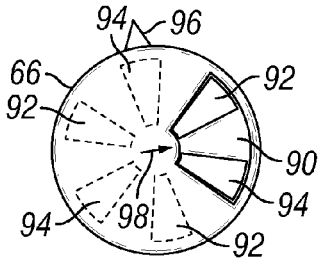
Figure 9N:
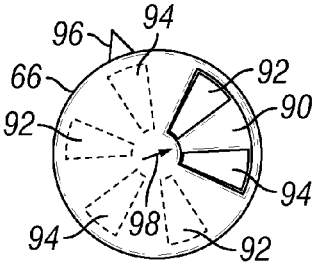
Figure 9O:
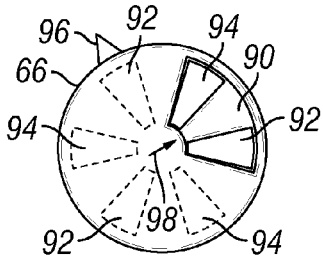

The orientation of spider valve 66 has again been changed relative to the drill collar 34 in the configuration illustrated in FIG. 7. In this configuration, the drill collar angle is 0° and the spider valve angle is 60° so that no movable steering pad 30 is activated. However, activating fluid 50 is vented to the annulus 100 to cause a negative pressure pulse. Again, because the valve opening 90 in the spider valve 66 is 90° and thus less than the angular separation between first (1) and third (3) activating ports 92, no flow of activating fluid 50 can be directed through any of the activating ports 92. In this configuration, no sideways force is generated by the steering pads 30 so this configuration may be employed to drill straight sections of wellbore 26. The spider valve 66 may be controlled according to a variety of control regimes to provide control over both the directional drilling and an additional functionality, e.g. providing telemetry pulses. In some applications, minimum venting or maximum venting of pressure to the annulus 100 may be employed while applying a desired deflection force, e.g. a maximum deflection force, to the rotary steerable system 28 and its drill bit 36.

FIG. 8 illustrates how spider valve 66 may be operated to achieve a maximum deflection of the rotary steerable system 28 while minimizing pressure vented to the annulus 100. In this illustration, the angular position of the drill collar 34 ranges from 0° to 120° in increments of 5° and 10°, although a similar sequence repeats for drill collar angles from 120° to 240° and from 240° to 360°. As illustrated, the spider valve angle is the same as the drill collar angle from 0° to 50°. In other words, the drill collar 34 and the spider valve 66 rotate with the same RPM in a counter-clockwise direction until they are both at 50°, leaving the first steering pad 30 activated while all vent ports 94 are closed. Once the 50° angular position is reached, the spider valve 66 is rotated rapidly in the clockwise direction until the spider valve angle reaches 25° when the drill collar angle reaches 55°. This relative position causes an adjacent vent port 94 to temporarily open which results in a brief negative pressure pulse lasting until the drill collar angle reaches 70° and the spider valve angle reaches −50°. At this point, the second steering pad 30 is activated and all vent ports 94 are again closed, as illustrated. The spider valve 66 is then rotated in the counter-clockwise direction with the same RPM as the drill collar 34 so that the second steering pad 30 remains activated during this period. When the drill collar angle reaches 120°, a similar sequence occurs which leads to activation of the third steering pad 30. Because of this controlled relative rotation of spider valve 66 with respect to activating ports 92 and vent ports 94, the vent openings remain closed except for brief periods and high pressure is maintained inside the drill collar 34 over substantial periods.

Assuming the drill collar 34 rotates at 180 RPM (3 Hz), the motor 72 should be capable of controlled rotation of spider valve 66 five times faster. Accordingly, the motor 72 is selected to drive the spider valve 66 at a minimum of 900 RPM (15 Hz) to enable the desired opening and closing of ports 92, 94.

FIG. 9 illustrates how spider valve 66 may be operated to achieve a maximum deflection of the rotary steerable system 28 while maximizing pressure vented to the annulus 100. In this illustration, the angular position of the drill collar 34 ranges from 0° to 120° in increments of 5° and 10°, although a similar sequence repeats for drill collar angles from 120° to 240° and from 240° to 360°. The example illustrates drill collar 34 positioned initially at 0° while the spider valve 66 is initially positioned at an angle of 30°. In this valve position, the valve opening 90 exposes both the first (1) activating port 92 and an adjacent vent port 94 to the pressurized activating fluid 50. In other words, the first (1) activating ports 92 and adjacent vent port 94 are both in an open position.

As illustrated, the drill collar 34 and the spider valve 66 rotate with the same RPM in a counter-clockwise direction until the drill collar angle reaches 50° and the spider valve angle reaches 80°. During this period of rotation, the first steering pad 30 remains activated and the vent port 94 adjacent first (1) activation port 92 remains open. When the drill collar angle reaches 50°, the spider valve 66 is rotated rapidly in the clockwise direction. When the drill collar angle reaches 55°, the spider valve angle also is at 55°. At this 55° angle, all vent ports 94 are closed which produces a short positive pressure pulse. As drill collar 34 continues to rotate and the drill collar angle reaches 60°, rotation of the spider valve 66 is controlled to transition the spider valve angle to 30° so that another vent port 94 is opened. The spider valve 66 is further rotated in a clockwise direction to an angle of −20° when the drill collar angle is at 70°. The motor 72 is then controlled to rotate the spider valve 26 back to a counter-clockwise rotation at the same RPM as the drill collar 34 so the valve opening 90 is aligned with both the second (2) activation port 92 and an adjacent vent port 94, thus activating the second steering pad 30. Once the drill collar angle reaches 120°, a similar sequence occurs which leads to activation of the third steering pad 30. Because of this controlled relative rotation of spider valve 66 with respect to activating ports 92 and vent ports 94, the pressure P1 is vented to the annulus 100 except for brief periods and a lower pressure is maintained inside the drill collar 34 over substantial periods.

FIGS. 8 and 9 illustrate examples of controlled rotation of the spider valve 66 relative to the drill collar 34 to create a desired pressure venting and a selective operation of the steering pads 30 during rotation of the drill collar. These examples represent two extreme cases of minimum and maximum pressure venting during the drill collar rotation, however a variety of intermediate cases may be employed for specific applications. The controlled venting and the creation of negative and/or positive pressure pulses is useful as a basis for communicating with other devices through, for example, mud pulse telemetry with a frequency lower than the rotation frequency of the drill collar 34.

Figure 10:
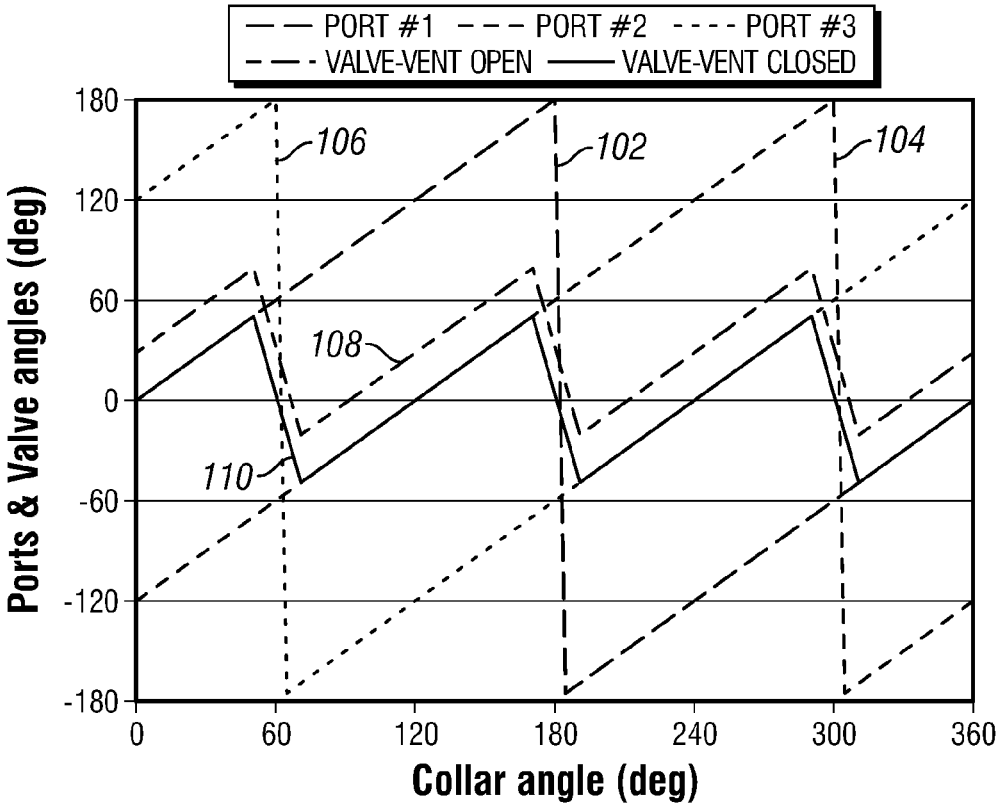
FIG. 10 is a graphical representation showing the drill collar angle versus the angular position of the rotational valve opening and the flow ports, according to an embodiment of the present invention.

In FIG. 10, the drill collar angle as represented by triangular marker 96 is plotted versus the angular position of first (1), second (2), and third (3) activating ports 92 (see graph lines 102, 104 and 106, respectively). The drill collar angle also is plotted versus the angular position of the spider valve 66 for maximum and minimum pressure venting (see graph lines 108, 110, respectively). However, the relative angular positions as well as the rotational speeds of the spider valve 66 and drill collar 34 may be selected/adjusted according to the parameters of a specific application.

Figure 11:
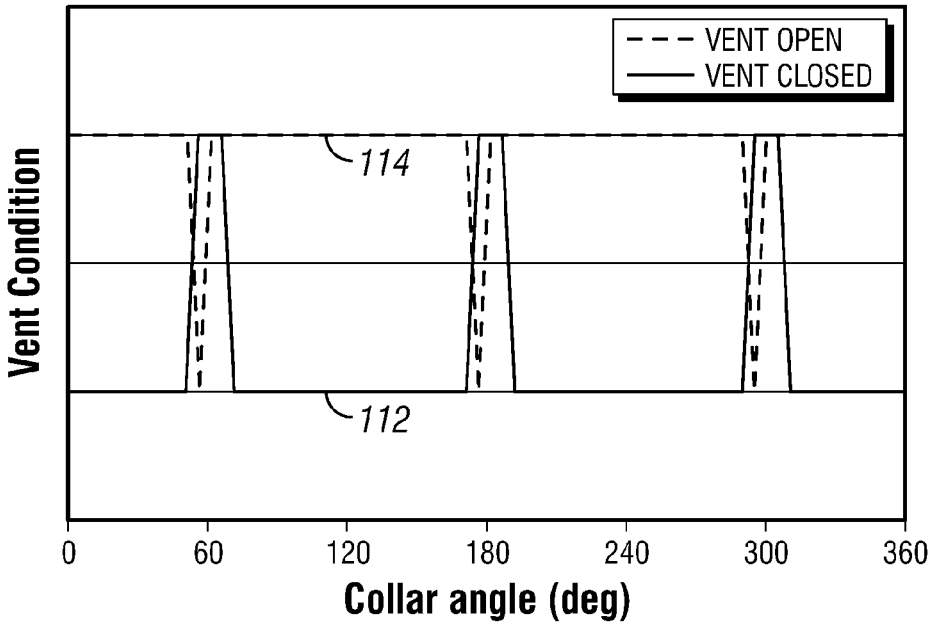
FIG. 11 is a graphical representation showing the drill collar angle versus the vent condition, according to an embodiment of the present invention.

FIG. 11 illustrates the corresponding vent conditions. Minimum venting occurs when the vent ports 94 are closed, as indicated by graph line 112, and maximum venting occurs when the vent ports 94 are open, as indicated by graph line 114. However, during the three transitions, brief pressure events occur which counteract the intended pressure state. For example, the pressure is vented 13% of the time during the example of relative rotations illustrated in FIG. 8 when the vent ports 94 are intended to be shut. However, the pressure is not vented 4% of the time during the example of relative rotations illustrated in FIG. 9 when the vent ports 94 are intended to be open. Accordingly, the efficiencies are 87% and 96%, respectively. The duration of these brief events can be further reduced by, for example, increasing the RPM of the spider valve 66 during the transitions.

With respect to the forces acting on the rotary steerable system 28, a curved wellbore section may be drilled by controlling the spider valve 66 to activate first, second and third steering pads 30 in a sequence designed to apply side forces on the drill collar 34. For example, to generate the maximum deflection in the negative x-direction, the spider valve 66 opens flow of activating fluid 50 to the steering pads 30 when they are aligned in the positive x-direction. The sequences illustrated in FIGS. 8 and 9 are examples of applying a deflecting force in the negative x-direction.

When only one port 92 is open at any instant, the forces on the bottom hole assembly/rotary steerable system can be calculated from the angle of the drill collar 34. The forces acting on the rotary steerable system in the x and y directions are given by $Fx=-F\cos(\theta)$ and $Fx=-F\sin(\theta)$ where $\theta$ is the angle of the drill collar modulo 120° and where F is the force the steering pad 30 exerts against the borehole wall. The force F is equal to the area of the hydraulic piston 64 times the differential pressure ($\Delta P$) between the piston chamber of the steering pad 30 and the borehole pressure. Provided the valve openings and the port openings are sufficiently large, the differential pressure is equal to the pressure drop between the inside and outside of the drill collar 34, i.e. $\Delta P=P1-P2$.

Figure 12:
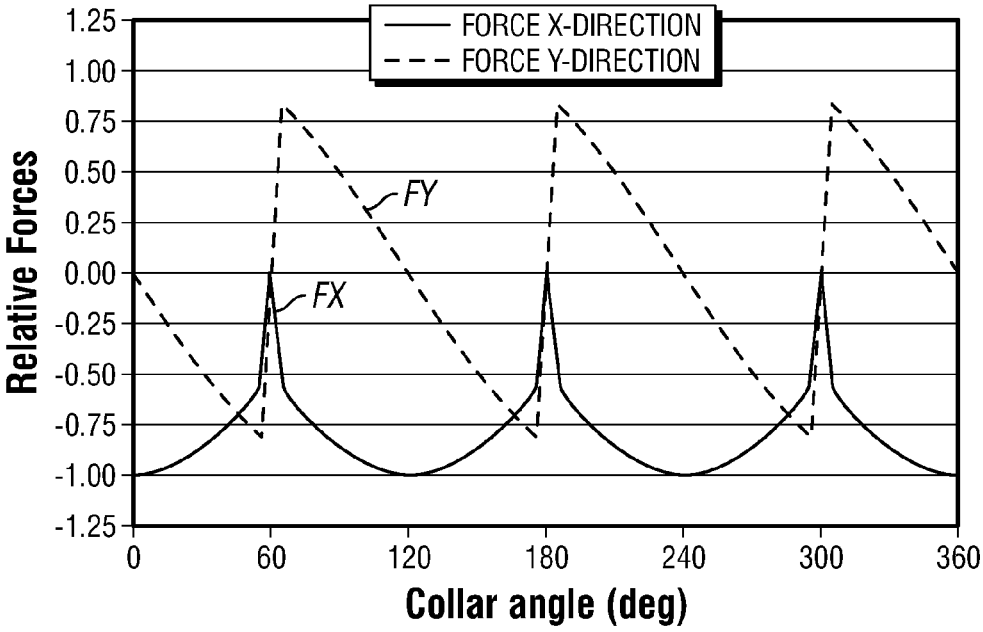
FIG. 12 is a graphical representation showing the drill collar angle versus the relative forces generated in the x and y directions, according to an embodiment of the present invention.

The x and y components of the force are plotted versus the angular position of the drill collar 34 in the graph of FIG. 12. The force in the x-direction is always negative or zero ($Fx\leq 0$) while the force in the y-direction is equally applied in the positive and negative directions. As illustrated, large excursions occur in the Fy component but the average force in the y-direction is zero. The drill bit deflection is proportional to the force component averaged over a revolution of the drill collar:

$$\langle Fx \rangle = \frac{1}{2\pi}\int_0^{2\pi} Fx(\theta)d\theta \text{ and } \langle Fy \rangle = \frac{1}{2\pi}\int_0^{2\pi} Fy(\theta)d\theta,$$

where θ is the drill collar angle. As noted above, <Fy> equals zero and therefore no net deflection occurs in the y-direction.

The vent ports 94 can be simply connected to the annulus 100 as illustrated in FIGS. 5, 6 and 7; or the vent ports 94 may be used to drive a fourth piston. The relatively slow sequences illustrated in FIGS. 8 and 9 are appropriate for driving a large piston to amplify the force available for a second function, such as generating pressure pulses, e.g. mud pulses, for telemetry signals. By way of example, a stronger negative pulse telemetry system may be incorporated into the rotary steerable system 28, an example of which is illustrated in FIGS. 13 and 14.

Figure 13:
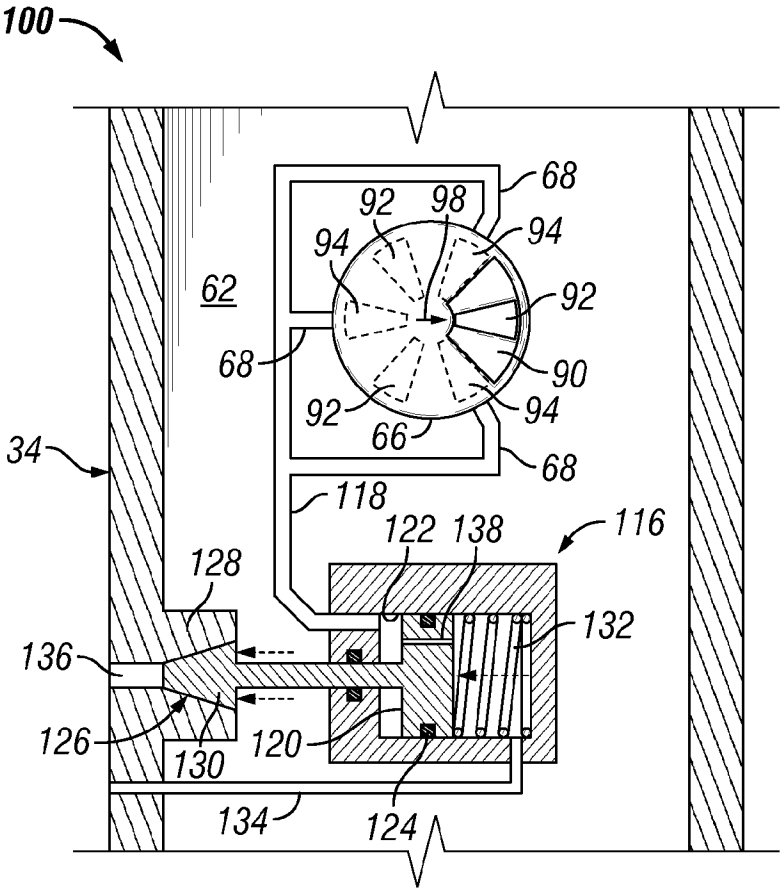
FIG. 13 is a schematic illustration of a telemetry system utilizing negative pressure pulses for telemetry signals, according to an embodiment of the present invention.

Referring initially to FIG. 13, an example is illustrated in which one or more vent ports 94, e.g. three vent ports 94, are connected to an accumulator piston assembly 116 by a hydraulic line 118. The accumulator piston assembly 116 comprises an accumulator piston 120 slidably mounted within a piston chamber 122 and the sealed thereto via an appropriate seal 124, such as an O-ring seal. In this example, the accumulator piston 120 drives a poppet valve 126 which may be located in a side wall 128 of the drill collar 34. The pressure differential (ΔP=P1−P2) between the inside of the drill collar 34 and the annulus 100 acts on a tapered head 130 of the poppet valve 126 and helps maintain the poppet valve in a closed position, as illustrated in FIG. 13. In addition, a mechanical spring 132 may be positioned within piston chamber 122 on an opposite side of accumulator piston 120 to bias the poppet valve 126 into the closed position. If the poppet valve 126 remains open for substantial periods, the drill collar wall 128 can undergo erosion. In the embodiment illustrated, the low-pressure side (P2) of the accumulator piston 120 is connected to the annulus 100 by a bleed line 134. In FIG. 13, the vent ports 94 are closed by spider valve 66 so the low pressure (P2) also exists in the hydraulic line 118 and in the piston chamber 122 on both sides of the accumulator piston 120.

Figure 14:
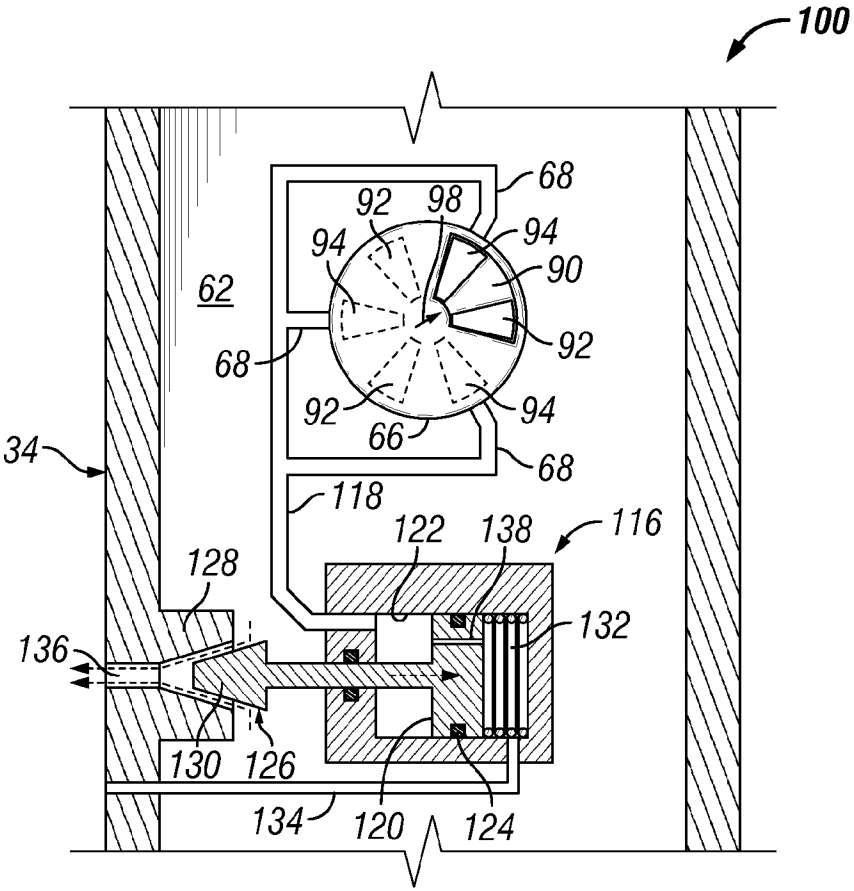
FIG. 14 is a schematic illustration similar to that of FIG. 13 but in a different operational configuration, according to an embodiment of the present invention.

In FIG. 14, the spider valve 66 has been rotated to open both the first (1) activating port 92 and an adjacent vent port 94 so that high pressure (P1) actuating fluid, e.g. drilling mud, is applied to the accumulator piston 120. As the high pressure fluid fills the hydraulic line 118 and shifts the accumulator piston 120, the mechanical spring force exerted by spring 132 and the force acting on tapered head 130 of poppet valve 126 are overcome. Consequently, the accumulator piston 120 forces the poppet valve 126 to an open position, as illustrated in FIG. 14. Because a sidewall opening 136 associated with poppet valve 126 is large, a large negative pressure pulse is generated. When the spider valve 66 is rotated to close all vent ports 94, the high pressure in the accumulator piston chamber 122 is drained off. The high pressure may be drained off through a bleed port or bleed line 138 extending through accumulator piston 120, thus allowing the mechanical spring 132 to close the poppet valve 126. Once closed, the differential pressure on the tapered head 130 of the poppet valve 126 maintains the valve in a closed state. In this embodiment, the pressure drop created by actuation of the spider valve 66 with respect to the vent ports 94 is amplified.

To communicate over large distances via pressure pulses, an embodiment may be designed to transmit pulses at relatively low frequencies, e.g. on the order of 1 Hz. If the drill collar 34 is rotating at 3 Hz in this example, then the accumulator piston 120 can be driven between open and shut states once every three drill collar rotations. In this example, the spider valve sequences illustrated in FIGS. 8 and 9 would be appropriate. The brief pressure pulses occurring during transitions and three times per rotation of the drill collar 34 would simply be averaged out due to the accumulator piston 120 serving as a low pass filter.

Figure 16:
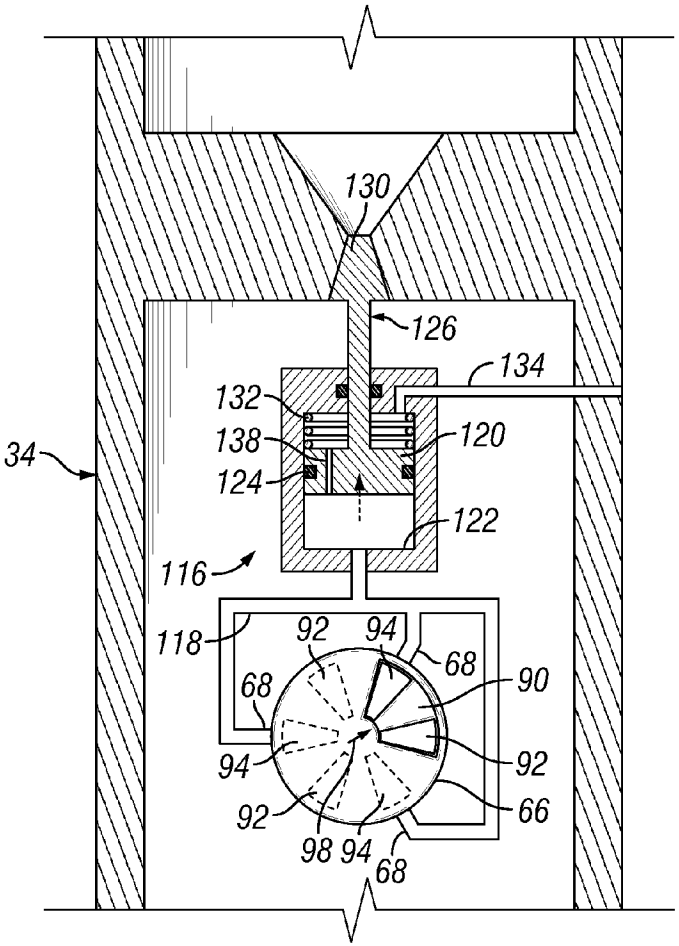
FIG. 16 is a schematic illustration similar to that of FIG. 15 but in a different operational configuration, according to an embodiment of the present invention.
Figure 15:
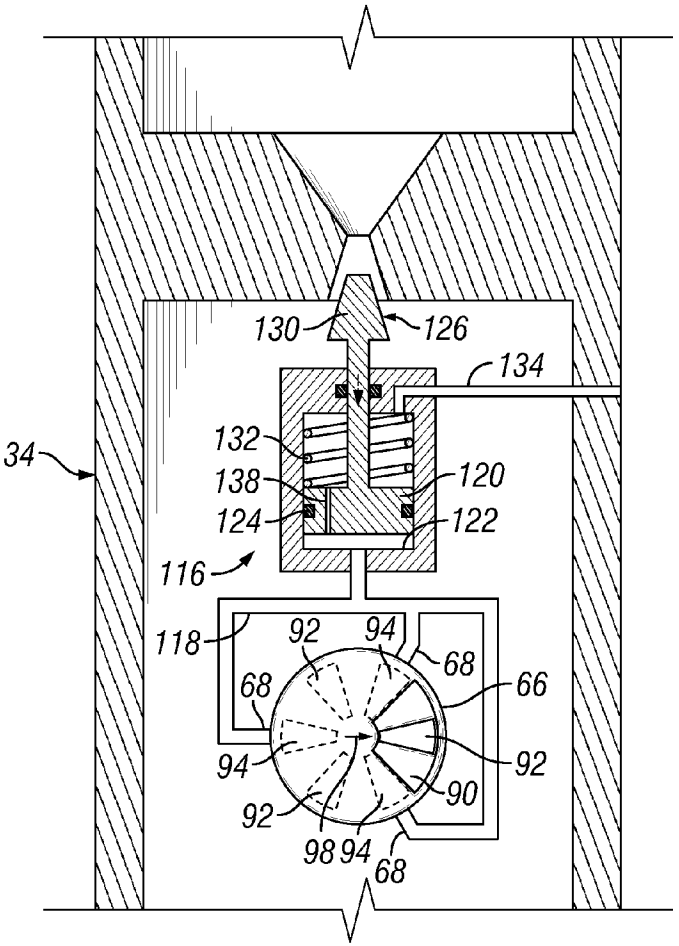
FIG. 15 is a schematic illustration of a telemetry system utilizing positive pressure pulses for telemetry signals, according to an embodiment of the present invention.
Figure 17A:
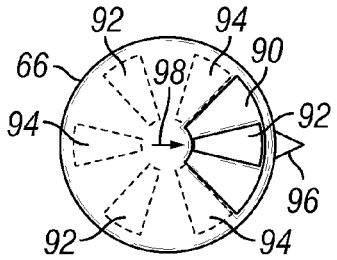
FIG. 17 is a schematic illustration of the corresponding positions of the rotational valve opening and the corresponding activating ports and vent ports during operation of the rotary steerable system to achieve a frequency of three times the drill collar RPM, according to an embodiment of the present invention.
Figure 17B:
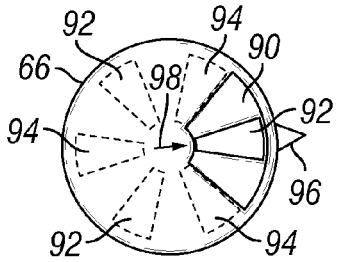
Figure 17C:
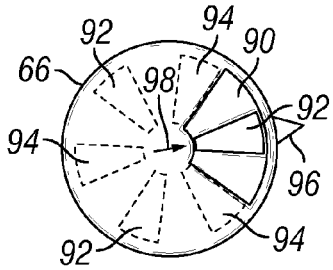
Figure 17D:
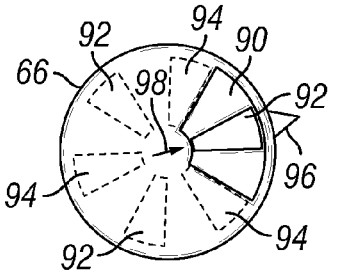
Figure 17E:
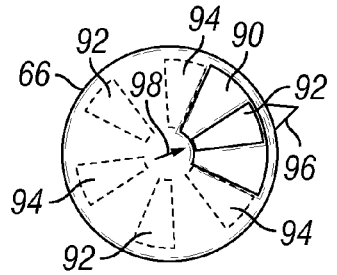
Figure 17F:
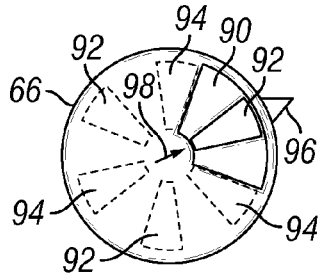
Figure 17G:
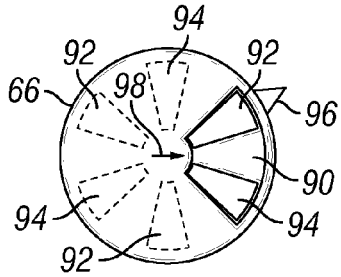
Figure 17H:
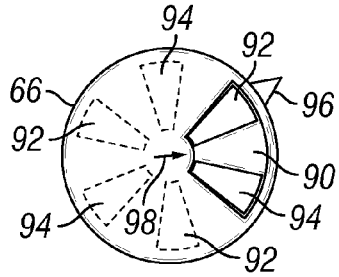
Figure 17I:
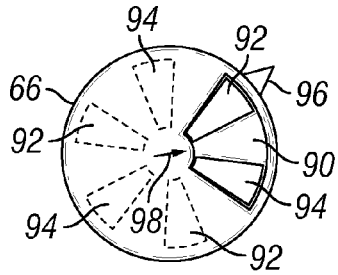
Figure 17J:
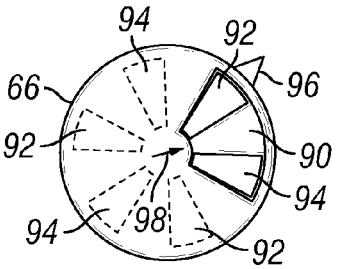
Figure 17K:
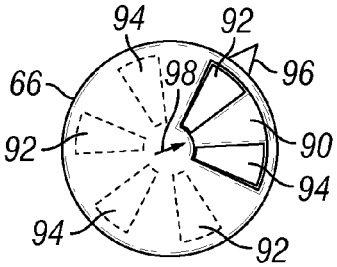
Figure 17L:
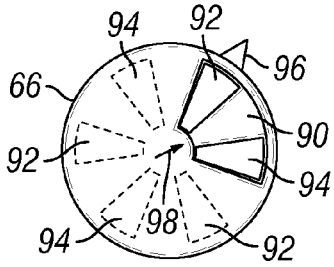
Figure 17M:
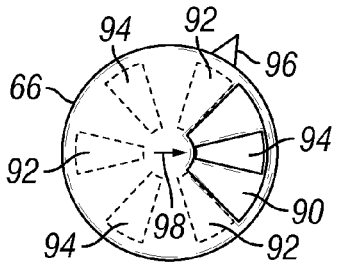
Figure 17N:
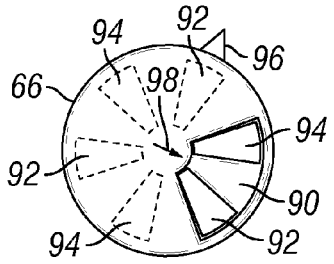
Figure 17O:
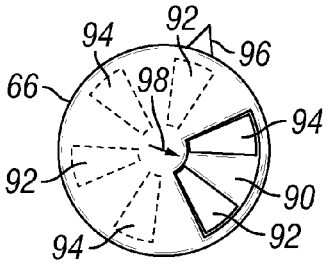
Figure 17P:
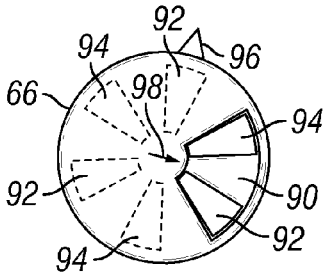
Figure 17Q:
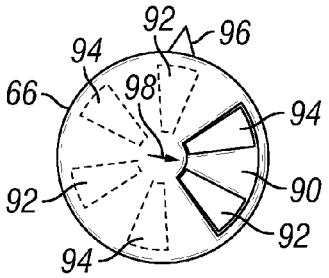
Figure 17R:
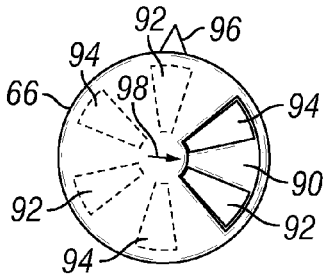
Figure 17S:
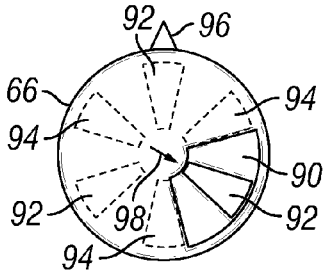
Figure 17T:
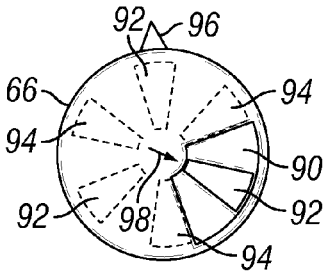
Figure 17U:
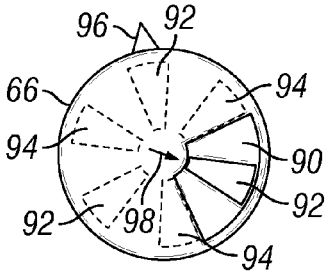
Figure 17V:
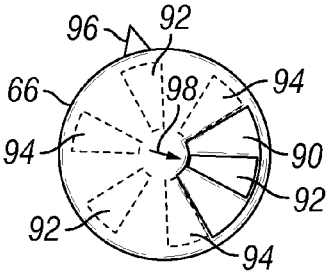
Figure 17W:
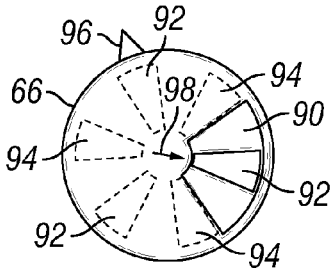
Figure 17X:
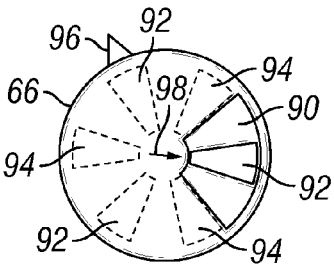
Figure 17Y:
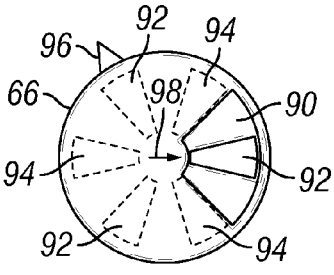

As illustrated in FIGS. 15 and 16, another embodiment may be constructed to create a positive pulse telemetry system, e.g. a positive mud pulse telemetry system. In this embodiment, the poppet valve 126 is positioned to temporarily block flow of actuating fluid 50, e.g. mud flow, inside the drill pipe to create a large positive pressure pulse. Because mud flow can only be briefly interrupted without affecting the drill process and the removal of cuttings, the poppet valve 126 is designed so activating fluid pressure, e.g. mud pressure, is the force that moves the poppet valve 126 to an open position. Additionally, the mechanical spring 132 may be positioned on an opposite side of the accumulator piston 120 (relative to the embodiment of FIGS. 13 and 14) to help maintain the poppet valve 126 in an open position.

In this embodiment, the poppet valve 126 is again driven by the accumulator piston 120, and bleed line 134 connects the low-pressure side of the accumulator piston 120 to the annulus pressure (P2). When the spider valve 66 is controlled to close all vent ports 94, the hydraulic line 118 coupled to the accumulator assembly 116 also is at the annulus pressure. Consequently, the poppet valve 126 is held open by the mechanical spring 132, as illustrated in FIG. 15.

To generate a positive pressure pulse, the poppet valve 126 is briefly closed (see FIG. 16). As illustrated, the spider valve 66 has been rotated to open both the first (1) activating port 92 and an adjacent vent port 94 so that high pressure (P1) actuating fluid 50, e.g. drilling mud, is applied to the accumulator piston 120. As the high pressure fluid fills the hydraulic line 118 and shifts the accumulator piston 120, the mechanical spring force exerted by spring 132 and the force acting on tapered head 130 of poppet valve 126 are overcome. Consequently, the accumulator piston 120 forces the poppet valve 126 to a closed position which results in a positive pressure pulse. When the spider valve 66 is rotated to close all vent ports 94, the high pressure in the accumulator piston chamber 122 is drained off through the bleed line 138 extending through accumulator piston 120, thus allowing the mechanical spring 132 to again open the poppet valve 126.

By way of example, the combined steering and pressure pulse telemetry system may be implemented in a variety of rotary steerable systems, such as a vertical rotary steerable system for drilling vertical wells. In embodiments employed to drill vertical wells, accelerometers may be used to properly orient the tool. In this particular embodiment, magnetometers are not necessary, so a minimalist telemetry system may be employed to transmit data to the surface from the vertical rotary steerable system. For example, the measurement while drilling data can be limited to transmitting the verticality of the well and the condition of the vertical rotary steerable system. If the well begins to significantly deviate from vertical, this may be an indication of a failure in the vertical rotary steerable system tool or a problem with the drill bit. Similarly, a status signal can be transmitted from the vertical rotary steerable system to indicate the system is operating properly. However, other applications of an accumulator piston 120 driven by spider valve 66 also may be utilized. For example, the system can be employed for mechanical activation of other devices, e.g. other pads, side thrusters, and other types of devices.

The embodiments described above demonstrate how the motor controlled spider valve system can be employed to generate signals for positive and negative pressure pulse telemetries in which the telemetry frequency is less than the real collar frequency. However, the system also may be employed to generate frequencies that are harmonics of the drill collar frequency.

Figure 18:
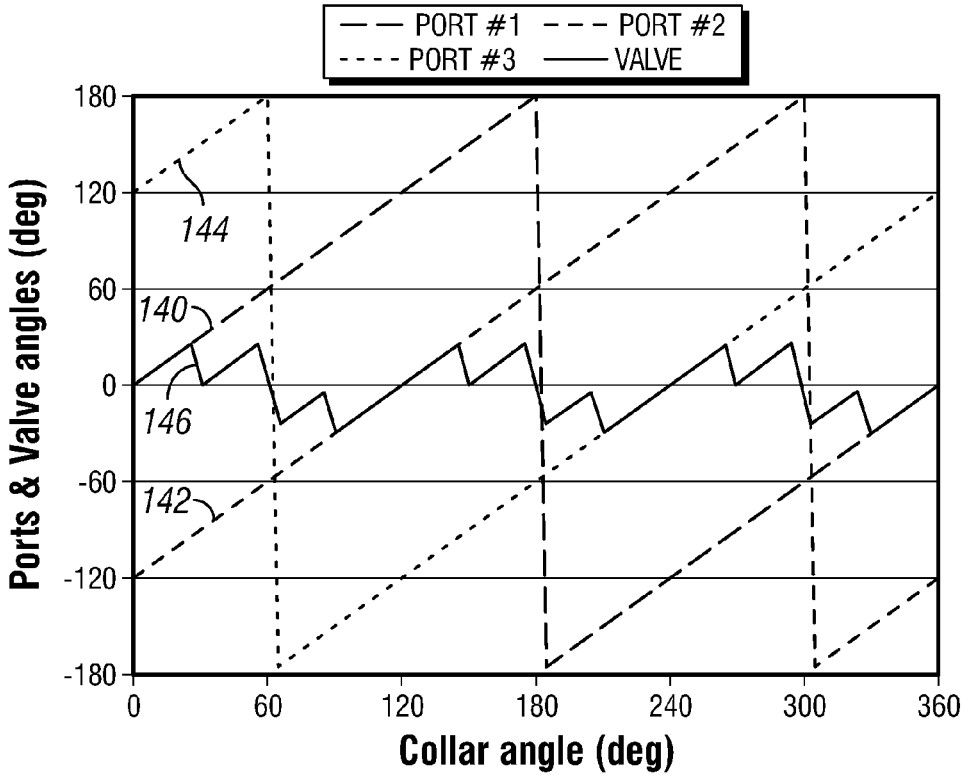
FIG. 18 is a graphical representation showing the drill collar angle versus the angular position of the rotational valve opening and the activation/vent ports during a drilling application such as that represented in FIG. 17, according to an embodiment of the present invention.
Figure 19:
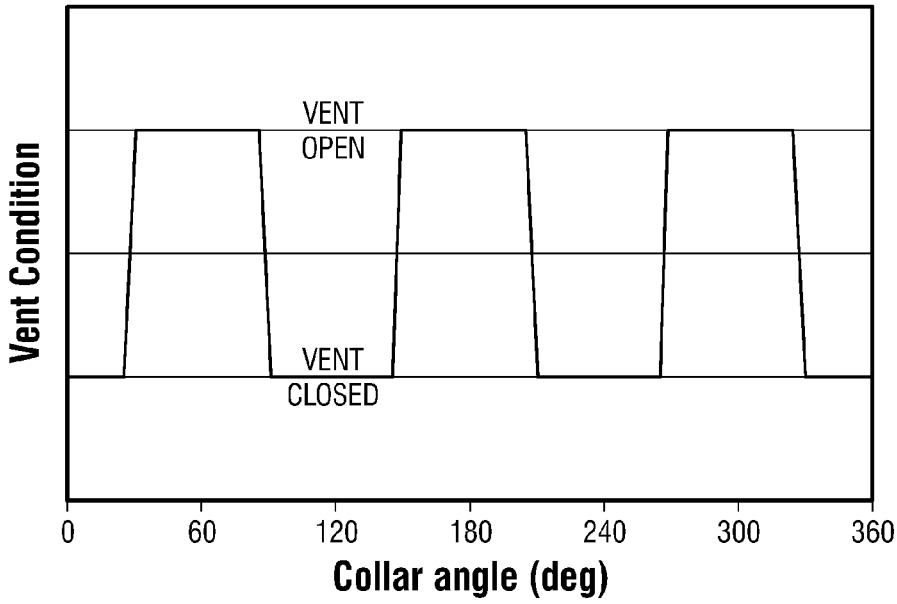
FIG. 19 is a graphical representation showing the drill collar angle versus the vent condition, according to an embodiment of the present invention.

Referring generally to FIGS. 17 and 18, an example has been provided in which the angular position of the spider valve 66 is controlled relative to the angular position of the drill collar 34 to achieve a frequency of three times the drill collar rotation frequency. By phasing the transitions of the spider valve 66 as illustrated in FIGS. 17 and 18, a clean square wave may be generated, as illustrated in FIG. 19. Referring again to FIG. 17, the drill collar 34 and the spider valve 66 both are initially positioned at 0° so no vent ports 94 are open. To generate a square wave with three times the frequency of the drill collar rotation, the spider valve 66 is controlled to open one of the vent ports 94 at a drill collar angle of 30°. As illustrated, the vent port 94 is already open during the spider valve transition from driving the first (1) activation port 92 to driving the second (2) activation port 92 from drill collar angles of 55° to 65°. This vent port 94 remains open until the drill collar angle reaches 90°, and then the spider valve 66 is rotated to an angle of −30°, thus shutting off all vent ports 94. It should be noted that the deflection forces acting on the rotary steerable system 28 in this example are the same as indicated for the previous examples (see FIG. 12). FIG. 18 provides a graphical illustration of drill collar angle plotted versus the angular position of the first (1), second (2), and third (3) activation ports 92 (represented by graph lines 140, 142 and 144, respectively) and versus the spider valve angle (represented by graph line 146).

Figure 20:
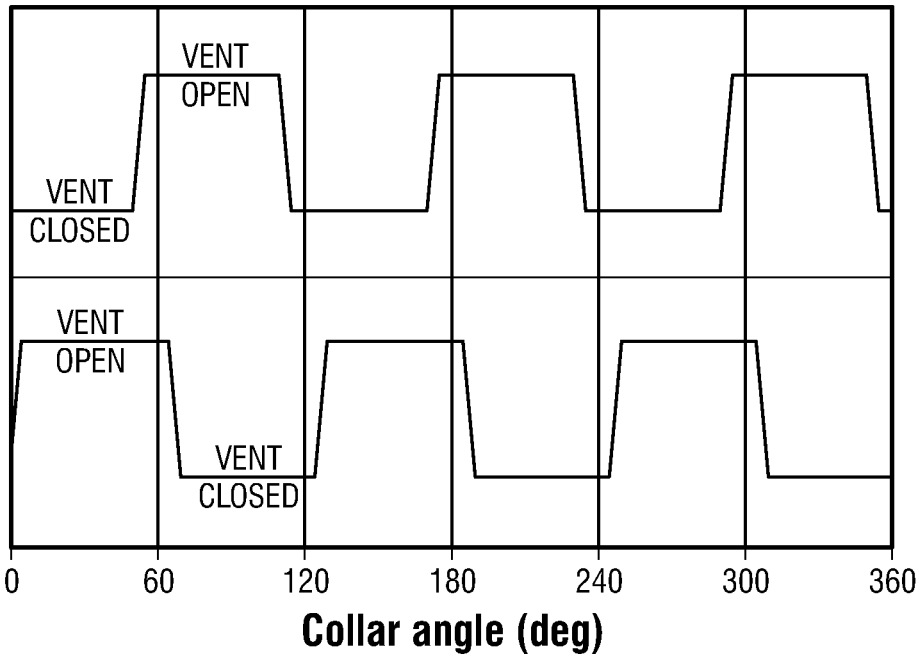
FIG. 20 is another graphical representation showing the drill collar angle versus the vent condition, according to an embodiment of the present invention.
Figure 21A:
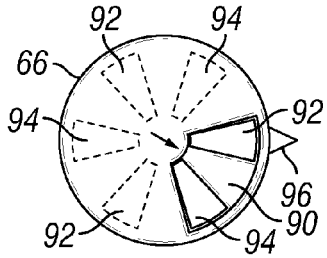
FIG. 21 is a schematic illustration of the corresponding positions of the rotational valve opening and the corresponding activating ports and vent ports during operation of the rotary steerable system to achieve a frequency of six times the drill collar RPM, according to an embodiment of the present invention.
Figure 21B:
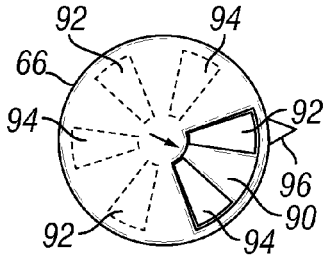
Figure 21C:
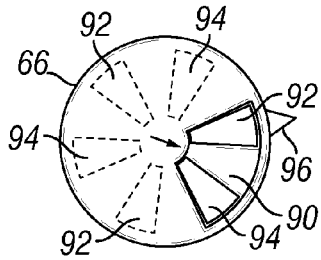
Figure 21D:
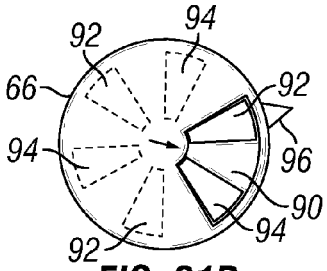
Figure 21E:
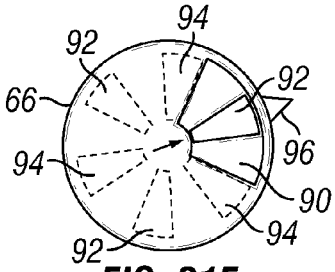
Figure 21F:
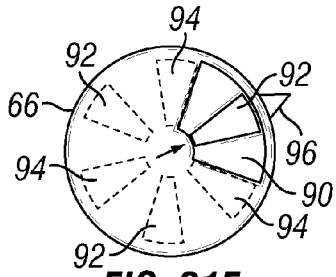
Figure 21G:
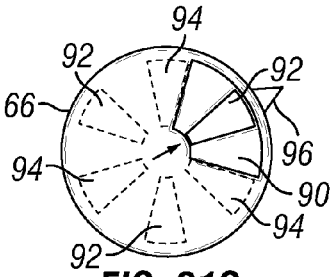
Figure 21H:
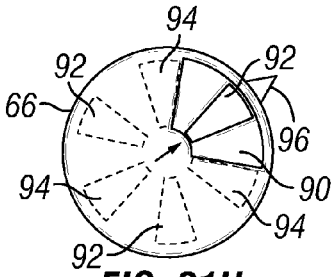
Figure 21I:
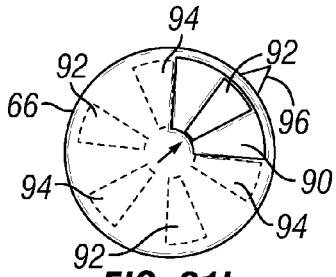
Figure 21J:
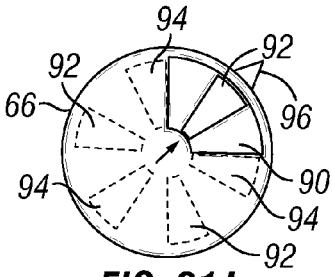
Figure 21K:
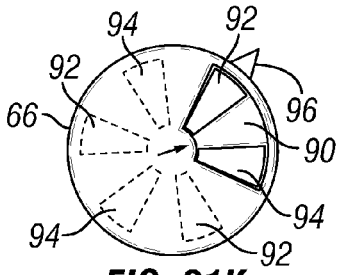
Figure 21L:
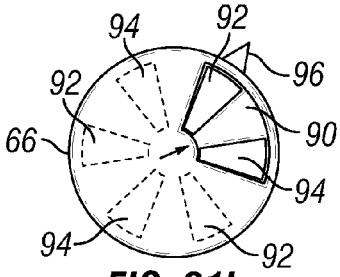
Figure 21M:
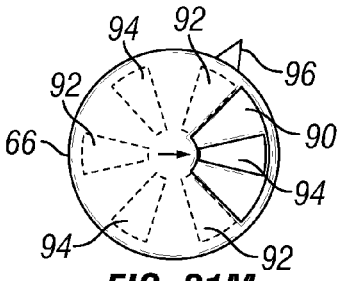
Figure 21N:
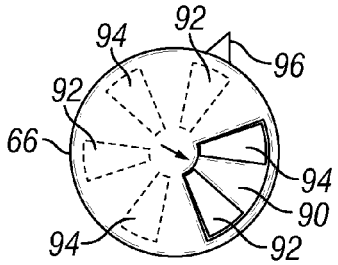
Figure 21O:
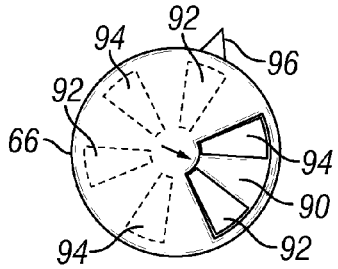
Figure 21P:
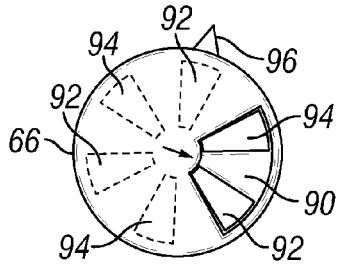
Figure 21Q:
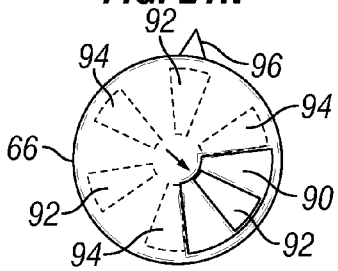
Figure 21R:
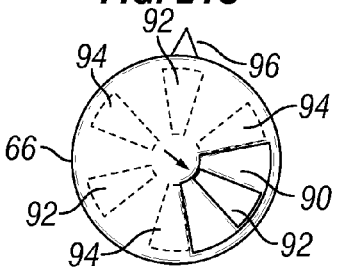
Figure 21S:
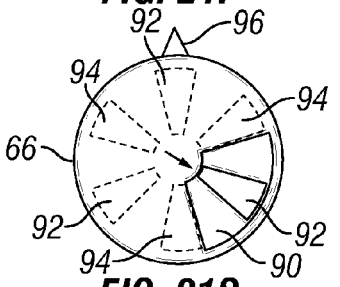
Figure 21T:
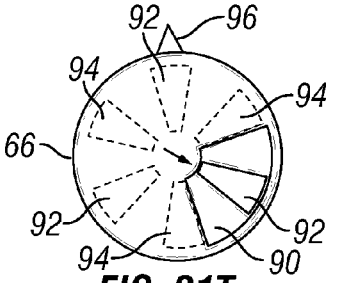
Figure 21U:
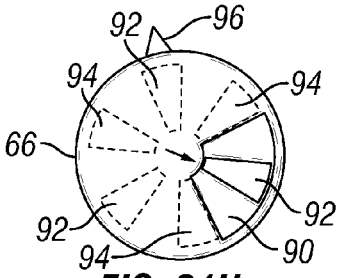
Figure 21V:
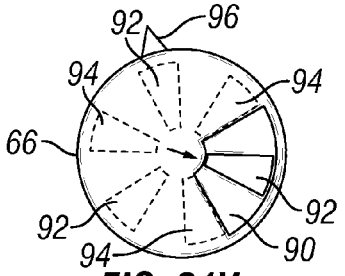
Figure 21W:
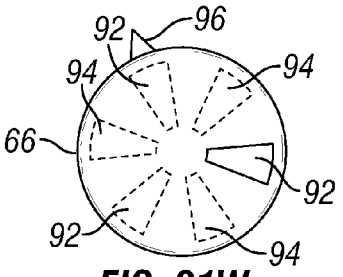
Figure 21X:
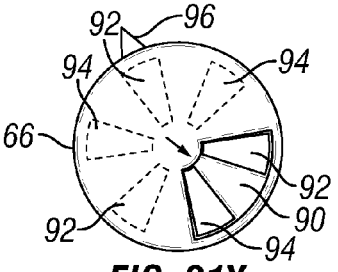
Figure 21Y:
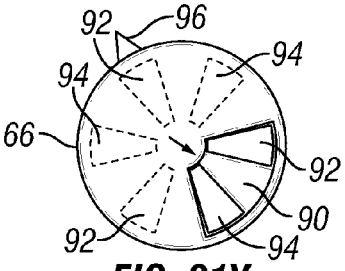

To transmit data using this frequency of three times the drill collar frequency as a carrier, a modulation scheme is employed. As illustrated in FIGS. 17 and 18, a vent port 94 is always open for drill collar angles from 55° to 65°, from 175° to 185°, and from 295° to 305°. The spider valve 66 may be controlled to modulate the pressure such that a vent is open from 5° to 65° or from 55° to 100°, as illustrated by the vent open/vent closed graph lines in FIG. 20. This provides an opportunity for phase shift keying for data transmission. It should be noted, however, 180° phase shifts may not be obtainable in the telemetry carrier, depending on the maximum rotation rate for the spider valve 66. In this example, the telemetry carrier phase shift is 135°.

Figure 22:
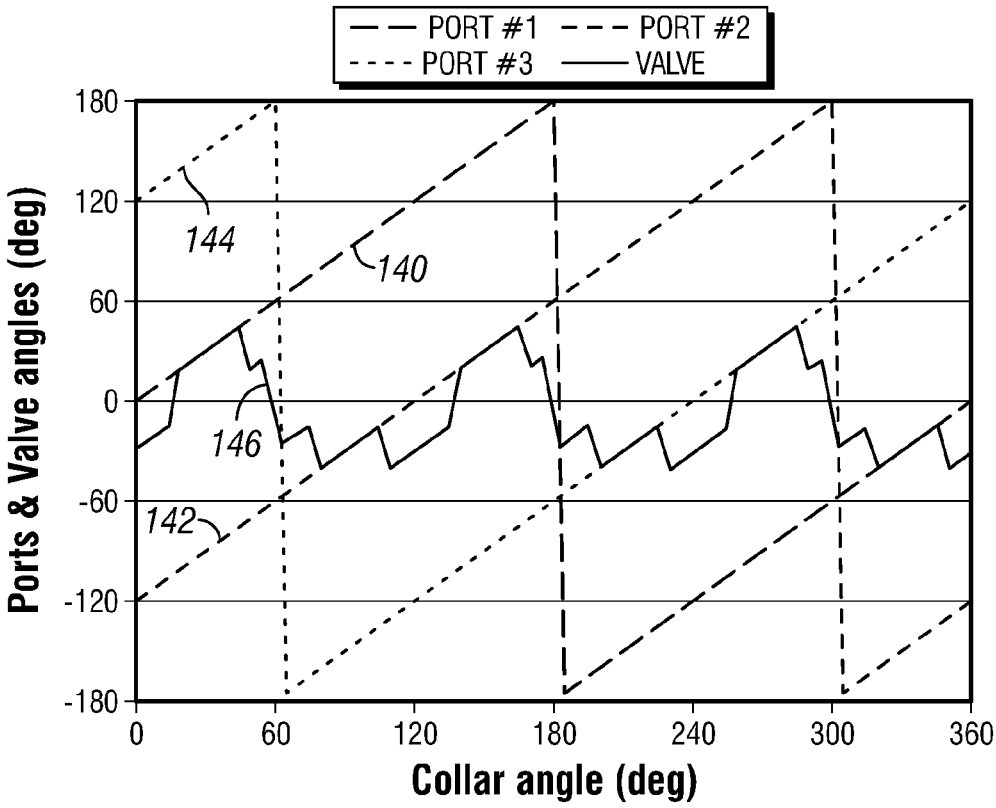
FIG. 22 is a graphical representation showing the drill collar angle versus the angular position of the rotational valve opening and the activation/vent ports during a drilling application such as that represented in FIG. 21, according to an embodiment of the present invention.
Figure 23:
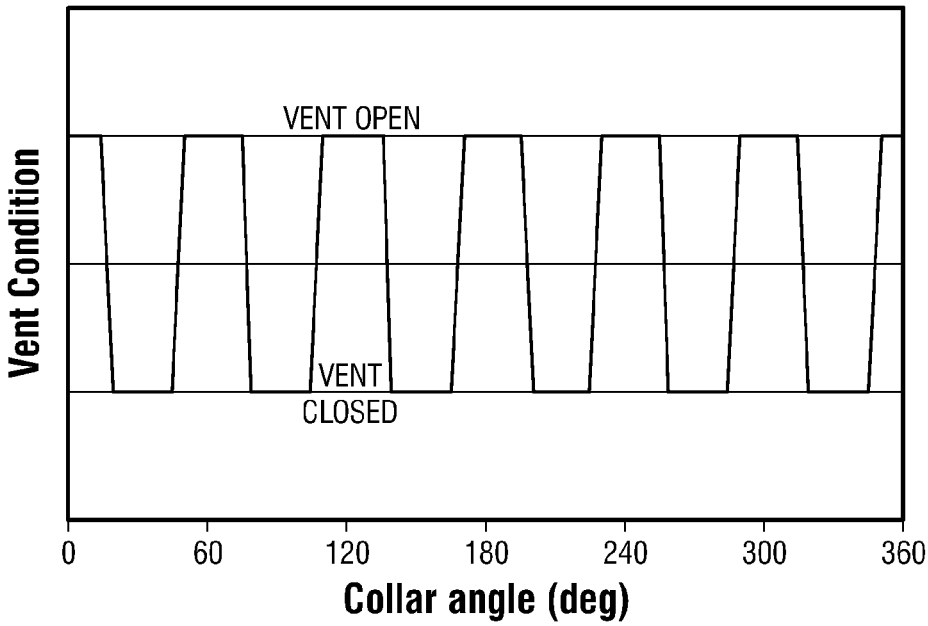
FIG. 23 is a graphical representation showing the drill collar angle versus the vent condition, according to an embodiment of the present invention.

The telemetry strategy also can be used to generate a clean square wave at other multiples of the drill collar rotation frequency. As illustrated in FIGS. 21-23, for example, the telemetry strategy is used to generate a clean square wave which is six times the drill collar rotation frequency. As described with respect to the embodiment illustrated in FIGS. 17-19, the spider valve 66 is transitioned so the low pressure wave during the telemetry transmission occurs when the spider valve 66 is switching from driving one actuating pad 30 to driving another actuating pad 30. Phase shift keying also is possible at this higher frequency, but the degree of phase shift may be less. It should be noted that other options may be employed, such as frequency keying. For example, the telemetry carrier of three times the drill collar rotation may be denoted "0" and the telemetry carrier of six times the drill collar rotation may be denoted "1" for use in frequency keying.

The well drilling system 20 and rotary steerable assembly may be constructed according to a variety of configurations with many types of components. The actual construction of the drilling system and the components selected depend on the type of wellbore desired and the size and shape of the reservoir accessed by the wellbore. For example, numerous types of drill collars, sensing systems, and other components may be incorporated into the drill string. The steering system may utilize a single steering pad 30 or a plurality of steering pads. If a plurality of steering pads is employed, the steering pads may be turned "off" by activating all of the steering pads simultaneously or, alternatively, by deactivating all of the steering pads simultaneously.

Furthermore, the rotational valve system may have a variety of sizes and configurations with additional valve openings arranged in desired angular patterns to correspond with actuating fluid ports and/or vent ports of the drill collar. The motor employed to operate the rotational valve may be an electric motor of a variety of sizes, configurations and power ratings depending on the parameters of a given application. Furthermore, the control system may comprise a microprocessor or other type of micro-controller which is programmable to operate the rotational valve according to a variety of paradigms for drilling straight and/or deviated sections of wellbore and for performing various telemetry functions or other additional functions. Additionally, the rotational valve, motor, and control system may be part of various types of drilling assemblies, including point-the-bit assemblies, push-the-bit assemblies, and hybrid assemblies.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for drilling a wellbore, comprising:

a rotary steerable system comprising:

a drill collar having a plurality of activation ports and a plurality of vent ports fixed at circumferential positions with respect to each other, the plurality of activation ports and the plurality of vent ports being oriented to receive fluid flow from a valve opening of a rotational valve, the valve opening being sized to selectively enable the fluid flow through an activation port, through a vent port, or simultaneously through both an activation port and a vent port depending on the angular orientation of the rotational valve with respect to the drill collar; and a plurality of movable steering pads mounted to the drill collar, the plurality of movable steering pads being hydraulically actuated by a fluid selectively directed through the plurality of activation ports, the plurality of vent ports being utilized for telemetry signals via pressure pulses;

the rotational valve being positioned in the drill collar to control access of the fluid to the plurality of activation ports for selectively actuating the plurality of movable steering pads and to the plurality of vent ports for providing telemetry signals.

2. The system as recited in claim 1, wherein the rotary steerable system further comprises an electric motor coupled to the spider valve, the electric motor being controlled to rotate the rotational valve in a manner which controls flow of fluid to desired ports of the plurality of ports.

3. The system as recited in claim 2, wherein the plurality of movable steering pads comprises three movable steering pads, and the plurality of ports comprises three activation ports and three vent ports.

4. The system as recited in claim 2, wherein the rotary steerable system further comprises an encoder positioned to measure an angular position of the rotational valve relative to the drill collar.

5. The system as recited in claim 4, wherein the rotary steerable system further comprises control electronics, the electric motor and the encoder being coupled to the control electronics, the control electronics tracking the orientation of the rotational valve with respect to the drill collar.

6. The system as recited in claim 5, wherein the electric motor, encoder, and control electronics are located within a pressure housing within the drill collar.

7. The system as recited in claim 2, wherein the spider valve is rotated by the electric motor to direct the fluid through the activation ports in a manner which selectively causes individual movable steering pads of the plurality of steering pads to extend while within a desired angular range of rotation of the drill collar.

8. The system as recited in claim 7, wherein the rotational valve is rotated by the electric motor to expose the fluid to the vent ports in a manner which creates pressure related telemetry signals.

9. The system as recited in claim 1, wherein the rotation of the rotational valve is selectively changed to change the severity of a dogleg being formed during drilling of the wellbore.

10. A method for drilling a wellbore, comprising:

providing a rotary steerable system with a drill collar having a plurality of ports exposed along a surface of the drill collar and arranged circumferentially with respect to each other on the drill collar;

rotatably positioning a valve in the drill collar to control flow of fluid under pressure to individual ports or simultaneously to more than one port of the plurality of ports; and using some ports of the plurality of ports to control extension of movable steering pads mounted to the drill collar to steer the rotary steerable system and using other ports of the plurality of ports to perform a second function by generating pressure pulses through the other ports at a frequency different from a drill collar frequency during rotation of the drill collar, the flow through selected other ports being toggled on and off while maintaining the valve in a position enabling flow to at least one of the plurality of ports which control extension of the movable steering pads.

11. The method as recited in claim 10, further comprising coupling an electric motor to the valve, and controlling the electric motor to rotate the valve in a manner which allows flow of fluid through desired ports of the plurality of ports to selectively steer the rotary steerable assembly and to provide telemetry signals.

12. The method as recited in claim 11, further comprising positioning an encoder in the rotary steerable system to measure an angular position of the valve relative to the drill collar.

13. The method as recited in claim 12, further comprising coupling the electric motor and the encoder to control electronics located within the rotary steerable system.

14. The method as recited in claim 13, further comprising locating the electric motor, encoder, and control electronics in a pressure housing within the drill collar.

15. The method as recited in claim 10, wherein using other ports comprises using the other ports to provide telemetry signals in the form of pressure changes.

16. The method as recited in claim 10, further comprising rotating the valve by the electric motor to direct the fluid through the plurality of ports in a manner which causes individual movable steering pads of the plurality of steering pads to extend while within a desired angular range of rotation of the drill collar and further rotating the valve in a manner which causes drilling of a straight section of the wellbore.

17. The method as recited in claim 10, further comprising rotating the valve by the electric motor to cause pressure pulses according to a pattern interpreted by another device downhole.

18. The method as recited in claim 10, further comprising selectively changing the rotation of the valve to change the severity of a dogleg being formed during drilling of the wellbore.

19. A method of forming a wellbore, comprising:

mounting a spider valve, having a spider valve opening, in a drill collar to control flow of an actuating fluid to at least one movable steering pad and to control telemetry signals via flow through the spider valve opening to a plurality of ports fixed in the drill collar for rotation with the drill collar during drilling;

coupling a motor to the spider valve; and rotating the spider valve with the motor in a manner which moves the spider valve opening along the plurality of ports for controlling flow of the actuating fluid through selected ports of the plurality of ports to cause drilling of the wellbore along a desired path and to cause a desired pattern of the telemetry signals by simultaneously flowing actuating fluid through a desired port of the plurality of ports and toggling another port of the plurality of ports to create the desired pattern of telemetry signals.

20. The method as recited in claim 19, further comprising controlling the motor via a micro-controller positioned with the motor at a location within the drill collar.

* * * * *